US008446397B2

(12) United States Patent
Kimura

(10) Patent No.: US 8,446,397 B2
(45) Date of Patent: May 21, 2013

(54) DISPLAY DEVICE, METHOD FOR DRIVING THE SAME, AND ELECTRONIC DEVICE USING THE DISPLAY DEVICE AND THE METHOD

(75) Inventor: Hajime Kimura, Atsugi (JP)

(73) Assignee: Semiconductor Energy Laboratory Co., Ltd., Atsugi-shi, Kanagawa-ken (JP)

( * ) Notice: Subject to any disclaimer, the term of this patent is extended or adjusted under 35 U.S.C. 154(b) by 705 days.

(21) Appl. No.: 12/629,083

(22) Filed: Dec. 2, 2009

(65) Prior Publication Data

US 2010/0141630 A1 Jun. 10, 2010

(30) Foreign Application Priority Data

Dec. 4, 2008 (JP) ..... 2008-309273

(51) Int. Cl.
*G09G 5/00* (2006.01)
*G09G 3/30* (2006.01)

(52) U.S. Cl.
USPC ..... 345/211; 345/76

(58) Field of Classification Search
None
See application file for complete search history.

(56) References Cited

U.S. PATENT DOCUMENTS

| | | | | |
|---|---|---|---|---|
| 7,046,220 | B2 | 5/2006 | Tagawa et al. | |
| 7,268,498 | B2 | 9/2007 | Miyagawa et al. | |
| 7,319,443 | B2 | 1/2008 | Kimura et al. | |
| 7,365,713 | B2 | 4/2008 | Kimura | |
| 7,456,810 | B2 | 11/2008 | Kimura | |
| 7,852,299 | B2 * | 12/2010 | Kawasaki et al. | 345/82 |
| 7,928,938 | B2 * | 4/2011 | Osame et al. | 345/82 |
| 2002/0005825 | A1 | 1/2002 | Lee et al. | |
| 2007/0215945 | A1 | 9/2007 | Tokunaga et al. | |
| 2008/0284312 | A1 | 11/2008 | Kimura | |

FOREIGN PATENT DOCUMENTS

| | | |
|---|---|---|
| JP | 2003-202834 | 7/2003 |
| JP | 2003-223138 | 8/2003 |
| JP | 2005-338792 | 12/2005 |

* cited by examiner

*Primary Examiner* — K. Wong
(74) *Attorney, Agent, or Firm* — Eric J. Robinson; Robinson Intellectual Property Law Office, P.C.

(57) ABSTRACT

An object is to reduce degradation of display quality due to variation in luminance of light-emitting elements, which is caused by variation in voltage because of wiring resistance of current supply lines, and to improve the display quality. In a voltage program period, a terminal serving as a source of a transistor for driving an EL element is electrically connected to a first wiring to which a first potential is supplied. In a light-emitting period, the terminal serving as the source of the driving transistor is electrically connected to a second wiring to which a second potential is supplied. Accordingly, voltage between a gate terminal and the source terminal of the driving transistor can be held without being adversely affected by wiring resistance of the current supply lines.

20 Claims, 16 Drawing Sheets

DISPLAY DEVICE, METHOD FOR DRIVING THE SAME, AND ELECTRONIC DEVICE USING THE DISPLAY DEVICE AND THE METHOD

BACKGROUND OF THE INVENTION

1. Field of the Invention

The present invention relates to a semiconductor device, a display device, and a light-emitting device, and a method for driving a semiconductor device, a display device, and a light-emitting device. Further, the present invention relates to an electronic device including the semiconductor device, the display device, or the light-emitting device.

2. Description of the Related Art

Display devices are used for a variety of electric products such as a mobile phone and a television receiver. As a display element used in a display device, a light-emitting element such as an EL element (an EL element containing an organic material and an inorganic material, an organic EL element, and an inorganic EL element) is favorable for improving the image quality because of high contrast ratio, high response speed to input signals, and wide viewing angle characteristics, and thus has been actively researched. Moreover, as for a display device including an EL element (hereinafter referred to as an EL display device), increase in screen size of the display device has been actively researched and developed.

In the EL display device, an EL element is driven in accordance with the amount of current flowing through the EL element. Accordingly, each pixel provided in a pixel portion, which is a display region in a display portion, is connected to a wiring for supplying current. The wiring for supplying current is formed using a wiring extended from the outside of the display region. Moreover, a TFT (thin film transistor) which is an element for controlling current supplied to the EL element is provided in each pixel of the pixel portion.

A TFT formed using polycrystalline silicon (polysilicon, hereinafter also referred to as p-Si) has high field effect mobility and excellent electric characteristics as compared to a TFT formed using amorphous silicon (hereinafter also referred to as a-Si), and thus is more suitable for a TFT used in an EL display device. On the other hand, TFTs formed using p-Si have a problem in that electric characteristics such as threshold voltage are likely to vary due to defects of bonding at crystal grain boundaries. Accordingly, as for a pixel including a TFT formed using p-Si, a structure including a circuit for compensating variation in threshold voltage of TFTs is disclosed (see Patent Documents 1 to 3).

REFERENCE

Patent Document 1: Japanese Published Patent Application No. 2003-202834

Patent Document 2: Japanese Published Patent Application No. 2003-223138

Patent Document 1: Japanese Published Patent Application No. 2005-338792

SUMMARY OF THE INVENTION

A period for driving a pixel in Patent Documents 1 to 3 is broadly classified into two periods: a period when a circuit for compensating threshold voltage of a transistor holds the threshold voltage and video voltage (hereinafter referred to as a voltage program period) and a period when an EL element emits light (hereinafter referred to as a light-emitting period). In the pixel structures in Patent Documents 1 to 3, when large current flows to each pixel from a wiring for supplying current in the voltage program period, voltage drop occurs due to wiring resistance of the wirings for supplying current, and thus voltages of the wirings for supplying current vary. Moreover, variation in voltage of the wirings for supplying current leads to variation in luminance of light-emitting elements and degradation in display quality.

Further, the wiring for supplying current is longer as a display device is larger, and voltage drop occurs due to adverse effect of wiring resistance of the wirings for supplying current, whereby voltages of the wirings for supplying current vary.

An object is to provide a display device which displays clear images without reduction in display quality even when the display device is larger.

Another object is to provide a display device in which large current can flow to each pixel so that higher luminance can be achieved.

Another object is to reduce degradation of display quality due to variation in luminance of light-emitting elements, which is caused by variation in voltage because of wiring resistance of wirings for supplying current.

One embodiment of the present invention is as follows. In a voltage program period, a terminal serving as a source of a transistor for driving an EL element (such a transistor is hereinafter also referred to as a driving transistor) is electrically connected to a first wiring to which a first potential is supplied. In a light-emitting period, the terminal serving as the source of the driving transistor is electrically connected to a second wiring to which a second potential is supplied. Accordingly, voltage between a gate terminal and the source terminal of the driving transistor can be held without being adversely affected by variation in voltage due to wiring resistance of the wirings for supplying current.

One illustrative embodiment of the present invention is a display device having a pixel including a transistor; a compensation circuit which is electrically connected to a first terminal, a second terminal, and a gate terminal of the transistor, and is configured to hold a threshold voltage applied between the gate terminal and the source terminal of the transistor and a video voltage; a light-emitting element electrically connected to the compensation circuit, wherein light emission is controlled depending on the threshold voltage and the video voltage; a first switch which is electrically connected to the first terminal of the transistor, and is configured to control electrical connection with a first wiring to which a first potential is supplied; and a second switch which is electrically connected to the first terminal of the transistor, and is configured to control electrical connection with a second wiring to which a second potential is supplied.

Another illustrative embodiment of the present invention is a method for driving a display device as follows. The display device includes a transistor; a compensation circuit which is electrically connected to a first terminal, a second terminal, and a gate terminal of the transistor, and is configured to hold in a capacitor a threshold voltage applied between the gate terminal and the source terminal of the transistor and a video voltage applied from a signal line through a selection switch; a light-emitting element electrically connected to the compensation circuit, wherein light emission is controlled depending on the threshold voltage and the video voltage; a first switch which is electrically connected to the first terminal of the transistor, and is configured to control electrical connection with a first wiring to which a first potential is supplied; and a second switch which is electrically connected to the first terminal of the transistor, and is configured to control electrical connection with a second wiring to which a second potential is supplied. In a voltage program period, the first switch is turned on and the second switch is turned off, and the capacitor is charged by turning on the transistor and then the capacitor is discharged, thereby holding the threshold voltage in the capacitor and supplying the video voltage by the selection switch. In a light-emitting period, the first switch is turned off and the second switch is turned on, and the light-emitting element is made to emit light.

In a display device in which each pixel is driven using a voltage program period and a light-emitting period, adverse effect of change in luminance of a light-emitting element due to wiring resistance of wirings for supplying current can be reduced, and image quality defects such as luminance gradients can be reduced. Moreover, adverse effect of wiring resistance of the wirings for supplying current, which is caused when the wiring for supplying current is longer as a display device is larger, can be reduced. A display device which displays clear images without reduction in display quality can be provided even when the display device is larger. Further, a display device can be provided in which large current can flow to each pixel so that higher luminance can be achieved. Furthermore, degradation of display quality due to variation in luminance of light-emitting elements, which is caused by variation in voltage because of wiring resistance of wirings for supplying current, can be reduced.

DETAILED DESCRIPTION OF THE INVENTION

Figure 1:
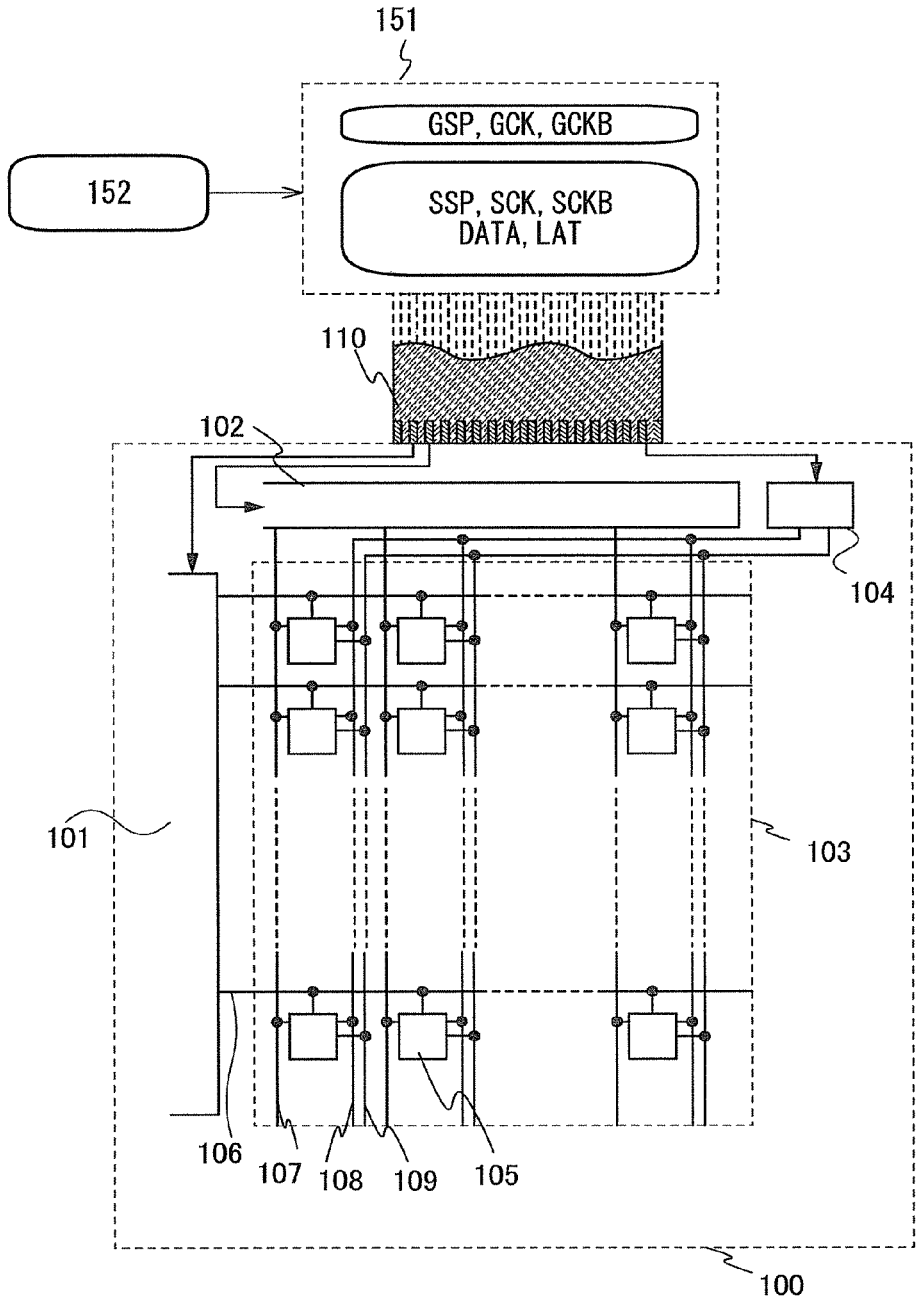
FIG. 1 illustrates Embodiment 1.

Embodiments of the present invention will be described below with reference to the accompanying drawings. Note that the present invention can be implemented in various modes, and it is easily understood by those skilled in the art that modes and details can be variously changed without departing from the spirit and the scope of the present invention. Therefore, the present invention is not construed as being limited to the description of the following embodiments. Note that in the drawings in this specification, the same portions or portions having similar functions are denoted by the same reference numerals, and description thereof is not repeated.

Note that what is described (or part thereof) in one embodiment can be applied to, combined with, or exchanged with another content in the same embodiment and/or what is described (or part thereof) in another embodiment or other embodiments.

Note that in each embodiment, what is described in the embodiment is a content described with reference to a variety of diagrams or a content described with a paragraph disclosed in this specification.

Explicit singular forms preferably mean singular forms. However, the present invention is not limited thereto, and such singular forms can include plural forms. Similarly, explicit plural forms preferably mean plural forms. However, the present invention is not limited thereto, and such plural forms can include singular forms.

In addition, by combining a diagram (or part thereof) described in one embodiment with another part of the diagram, a different diagram (or part thereof) described in the same embodiment, and/or a diagram (or part thereof) described in one or a plurality of different embodiments, much more diagrams can be formed.

Note that the size, the thickness of layers, or regions in diagrams are sometimes exaggerated for simplicity. Therefore, embodiments of the present invention are not limited to such scales.

Note that diagrams are perspective views of ideal examples, and embodiments of the present invention are not limited to the shape or the value illustrated in the diagrams. For example, the following can be included: variation in shape due to a manufacturing technique or dimensional deviation; or variation in signal, voltage, or current due to noise or difference in timing.

Note that technical terms are used in order to describe a specific embodiment or the like in many cases, and there are no limitations on terms.

Note that terms which are not defined (including terms used for science and technology, such as technical terms or academic parlance) can be used as the terms which have meaning equal to general meaning that an ordinary person skilled in the art understands. It is preferable that the term defined by dictionaries or the like be construed as consistent meaning with the background of related art.

Note that the terms such as first, second, and third are used for distinguishing various elements, members, regions, layers, and areas from others. Therefore, the terms such as first, second, and third do not limit the number of elements, members, regions, layers, areas, or the like. Further, for example, "first" can be replaced with "second", "third", or the like.

Embodiment 1

First, a block diagram of a display device for illustrating a structure in this embodiment will be described.

FIG. 1 illustrates a structure of a gate line driver circuit 101, a signal line driver circuit 102, a display portion 103, and a power supply circuit 104 which are included in a display device 100. In the display portion 103, a plurality of pixels 105 are arranged in matrix. FIG. 1 also illustrates a signal generation circuit 151 for generating a signal input to the display device.

In FIG. 1, the gate line driver circuit 101 supplies scan signals to a plurality of wirings 106. By these scan signals, the pixels 105 are determined to be in a selected state or a non-selected state per row. The signal line driver circuit 102 supplies a video voltage (also referred to as a video signal or video data) from a wiring 107 to the pixel 105 selected by the scan signal. The power supply circuit 104 generates a first potential supplied to a wiring 108 (also referred to as a first wiring) connected to the plurality of pixels 105, and a second potential supplied to a wiring 109 (also referred to as a second wiring).

Note that the wiring 106 can function as a gate wiring for supplying a scan signal to each row. The wiring 107 can function as a source wiring for supplying a video voltage to each pixel. The wiring 108 can function as a first current supply line for supplying the first potential to the pixel 105. The wiring 109 can function as a second current supply line for supplying the second potential to the pixel 105.

FIG. 1 illustrates the wirings 106, 107, 108, and 109 corresponding to the number of pixels in the row and column directions. Note that as for the wirings 106, 107, 108, and 109, the number of wirings 106, 107, 108, and 109 which are connected to the pixel 105 may be increased in accordance with the number of subpixels (also referred to as sub-pixels) forming the pixel or the number of transistors in the pixel. The pixels 105 may be driven while the wirings 106, 107, 108, and 109 are shared among the pixels, so that the number of wirings 106, 107, 108, and 109 which are connected to the pixels 105 can be reduced.

FIG. 1 illustrates the case where signals input to the gate line driver circuit 101, the signal line driver circuit 102, and the power supply circuit 104 are input from a flexible printed circuit (FPC) 110. Note that any one of the gate line driver circuit 101, the signal line driver circuit 102, and the power supply circuit 104 may be provided over the same substrate as the display portion 103. Alternatively, only the display portion 103 may be formed over a substrate. As an example, the gate line driver circuit 101 and the signal line driver circuit 102 are formed over the same substrate as the display portion 103, and the power supply circuit 104 for generating the first potential and the second potential is formed over a printed wiring board (PWB) which is placed outside the substrate and provided with a control circuit. Note that when the first and second potentials supplied to the wirings 108 and 109 are externally supplied through the flexible printed circuit 110, there is no need to provide the power supply circuit 104, whereby the size of the display device 100 can be reduced.

The signal generation circuit 151 has a function of outputting a signal, voltage, or the like to each circuit in the display device 100 through the flexible printed circuit 110 in accordance with an image signal 152, and can function as a controller, a control circuit, a timing generator, a regulator, or the like.

As an example, the signal generation circuit 151 outputs to the display device 100 signals such as a signal line driver circuit start signal (SSP), a signal line driver circuit clock signal (SCK), a signal line driver circuit inverted clock signal (SCKB), video voltage data (DATA), a latch signal (LAT), a gate line driver circuit start signal (GSP), a gate line driver circuit clock signal (GCK), and a gate line driver circuit inverted clock signal (GCKB). Moreover, the signal generation circuit 151 outputs a signal of constant voltage, which is input to a circuit such as the power supply circuit 104 in the display device 100. The gate line driver circuit 101, the signal line driver circuit 102, and the power supply circuit 104 in the display device can make the display portion 103 display an image in accordance with these signals.

As described above, the plurality of pixels 105 are arranged in matrix (in stripes) in the display portion 103 in FIG. 1. Note that the pixels 105 are not necessarily arranged in matrix and may be arranged in a delta pattern or Bayer arrangement. As a display method of the display portion 103, a progressive method or an interlace method can be employed. Note that by employing the interlace method so that a signal is supplied to a plurality of pixels to perform display, driving frequency can be reduced and low power consumption can be achieved. Note that color elements controlled in the pixel for color display are not limited to three colors of R (red), G (green), and B (blue), and color elements of more than three colors may be employed, for example, RGBW (W corresponds to white), or RGB added with one or more of yellow, cyan, magenta, and the like. Further, the size of display regions may be different between respective dots of color elements. Thus, power consumption can be reduced, and the life of a display element can be prolonged.

Note that when it is explicitly described that "A and B are connected", the case where A and B are electrically connected, the case where A and B are functionally connected, and the case where A and B are directly connected are included therein. Here, each of A and B is an object (e.g., a device, an element, a circuit, a wiring, an electrode, a terminal, a conductive film, or a layer). Accordingly, another element may be provided between elements having a connection relation illustrated in drawings and texts, without limitation on a predetermined connection relation, for example, the connection relation illustrated in the drawings and the texts.

For example, in the case where A and B are electrically connected, one or more elements which enable electrical connection between A and B (e.g., a switch, a transistor, a capacitor, an inductor, a resistor, and/or a diode) may be connected between A and B. In the case where A and B are functionally connected, one or more circuits which enable functional connection between A and B (e.g., a logic circuit such as an inverter, a NAND circuit, or a NOR circuit; a signal converter circuit such as a DA converter circuit, an AD converter circuit, or a gamma correction circuit; a potential level converter circuit such as a power supply circuit (e.g., a dc-dc converter, a step-up dc-dc converter, or a step-down dc-dc converter) or a level shifter circuit for changing a potential level of a signal; a voltage source; a current source; a switching circuit; an amplifier circuit such as a circuit which can increase signal amplitude, the amount of current, or the like, an operational amplifier, a differential amplifier circuit, a source follower circuit, or a buffer circuit; a signal generation circuit; a memory circuit; and/or a control circuit) may be connected between A and B. For example, in the case where a signal output from A is transmitted to B even when another circuit is provided between A and B, A and B are functionally connected.

Note that when it is explicitly described that "A and B are electrically connected", the case where A and B are electrically connected (i.e., the case where A and B are connected with another element or another circuit therebetween), the case where A and B are functionally connected (i.e., the case where A and B are functionally connected with another circuit therebetween), and the case where A and B are directly connected (i.e., the case where A and B are connected without another element or another circuit therebetween) are included therein. That is, when it is explicitly described that "A and B are electrically connected", the description is the same as the case where it is explicitly only described that "A and B are connected".

Note that a display device is a device including a display element whose contrast, luminance, reflectivity, transmittance, or the like changes by electromagnetic action, such as an EL (electroluminescence) element (e.g., an EL element containing organic and inorganic materials, an organic EL element, or an inorganic EL element), an LED (e.g., a white LED, a red LED, a green LED, or a blue LED), a transistor (a transistor which emits light depending on the amount of current), an electron emitter, a liquid crystal element, electronic ink, an electrophoretic element, a grating light valve (GLV), a plasma display panel (PDP), a digital micromirror device (DMD), a piezoelectric ceramic display, or a carbon nanotube. The display device may include a plurality of pixels each having a display element such as a light-emitting element. Moreover, the display device may include a peripheral driver circuit for driving the plurality of pixels. The peripheral driver circuit for driving the plurality of pixels may be formed using the same substrate as the plurality of pixels. The display device may include a peripheral driver circuit provided over a substrate by wire bonding or bump bonding, namely, an IC chip connected by chip on glass (COG) or an IC chip connected by TAB or the like. The display device may include a flexible printed circuit (FPC) to which an IC chip, a resistor, a capacitor, an inductor, a transistor, or the like is attached. The display device may include a printed wiring board (PWB) which is connected through a flexible printed circuit (FPC) and to which an IC chip, a resistor, a capacitor, an inductor, a transistor, or the like is attached. The display device may include an optical sheet such as a polarizing plate or a retardation plate. The display device may include a lighting device, a housing, an audio input and output device, an optical sensor, or the like.

As the transistors included in the pixel 105 and the driver circuits, a variety of transistors can be used. There is no limitation on the type of transistors. For example, a thin film transistor (TFT) including a non-single-crystal semiconductor film typified by a film made of amorphous silicon, polycrystalline silicon, microcrystalline (also referred to as microcrystal, nanocrystal, or semi-amorphous) silicon, or the like can be used. In the case of using the TFT, there are various advantages. For example, since the TFT can be formed at temperature lower than that of the case of using single crystal silicon, manufacturing costs can be reduced or a manufacturing apparatus can be made larger. Since the manufacturing apparatus can be made larger, the TFT can be formed using a large substrate. Accordingly, a lot of display devices can be formed at the same time at low cost. In addition, since the manufacturing temperature is low, a substrate having low heat resistance can be used. Therefore, the transistor can be formed using a light-transmitting substrate. Further, transmission of light in a display element can be controlled by using the transistor formed using the light-transmitting substrate. Alternatively, part of a film included in the transistor can transmit light because the thickness of the transistor is small. Accordingly, the aperture ratio can be improved.

Note that by using a catalyst (e.g., nickel) in the case of forming polycrystalline silicon, crystallinity can be further improved and a transistor having excellent electrical characteristics can be formed. Accordingly, a gate driver circuit (a scan line driver circuit), a source driver circuit (a signal line driver circuit), and/or a signal processing circuit (e.g., a signal generation circuit, a gamma correction circuit, or a DA converter circuit) can be formed using one substrate.

Note that by using a catalyst (e.g., nickel) in the case of forming microcrystalline silicon, crystallinity can be further improved and a transistor having excellent electrical characteristics can be formed. In this case, crystallinity can be improved by just performing heat treatment without performing laser irradiation. Accordingly, a gate driver circuit (a scan line driver circuit) and part of a source driver circuit (e.g., an analog switch) can be formed using the same substrate. Moreover, in the case of not performing laser irradiation for crystallization, unevenness in crystallinity of silicon can be suppressed. Thus, high-quality images can be displayed.

Note also that polycrystalline silicon and microcrystalline silicon can be formed without using a catalyst (e.g., nickel).

Note that it is preferable that crystallinity of silicon be enhanced to polycrystallinity, microcrystallinity, or the like in the whole panel; however, the present invention is not limited to this. Crystallinity of silicon may be improved only in part of the panel. Selective improvement in crystallinity is realized by selective laser irradiation or the like. For example, only a peripheral driver circuit region excluding pixels may be irradiated with laser light. Alternatively, only a region of a gate driver circuit, a source driver circuit, or the like may be irradiated with laser light. Alternatively, only part of a source driver circuit (e.g., an analog switch) may be irradiated with laser light. Accordingly, crystallinity of silicon can be improved only in a region where a circuit needs to operate at high speed. Since a pixel region is not particularly needed to operate at high speed, the pixel circuit can operate without problems even if the crystallinity is not improved. Since a region whose crystallinity is to be improved is small, manufacturing steps can be shortened, the throughput can be increased, and manufacturing costs can be reduced. Since the number of manufacturing apparatuses needed is small, manufacturing costs can be reduced.

A transistor can be formed using a semiconductor substrate, an SOI substrate, or the like. Thus, a transistor with few variations in characteristics, sizes, shapes, or the like, with high current supply capability, and with a small size can be formed. By using such a transistor, power consumption of a circuit can be reduced or a circuit can be highly integrated.

A transistor including a compound semiconductor or an oxide semiconductor, such as ZnO, a-InGaZnO, SiGe, GaAs, IZO, ITO, or SnO, a thin film transistor obtained by thinning such a compound semiconductor or an oxide semiconductor, or the like can be used. Thus, manufacturing temperature can be lowered and for example, a transistor can be formed at room temperature. Accordingly, the transistor can be formed directly on a substrate having low heat resistance, such as a plastic substrate or a film substrate. Note that such a compound semiconductor or an oxide semiconductor can be used not only for a channel portion of the transistor but also for other applications. For example, such a compound semiconductor or an oxide semiconductor can be used for a resistor, a pixel electrode, or a light-transmitting electrode. Further, since such an element can be formed at the same time as the transistor, costs can be reduced.

A transistor or the like formed by an inkjet method or a printing method can be used. Thus, a transistor can be formed at room temperature, can be formed at a low vacuum, or can be formed using a large substrate. Since the transistor can be formed without using a mask (reticle), the layout of the transistor can be easily changed. Further, since it is not necessary to use a resist, material cost is reduced and the number of steps can be reduced. Furthermore, since a film is formed only in a portion where needed, a material is not wasted as compared to a manufacturing method by which etching is performed after the film is formed over the entire surface, so that costs can be reduced.

A transistor or the like including an organic semiconductor or a carbon nanotube can be used. Accordingly, a transistor can be formed over a flexible substrate. A semiconductor device formed using such a substrate can resist shocks.

Further, transistors with a variety of structures can be used. For example, a MOS transistor, a junction transistor, a bipolar transistor, or the like can be used as a transistor. By using a MOS transistor, the size of the transistor can be reduced. Thus, a large number of transistors can be mounted. By using a bipolar transistor, large current can flow. Thus, a circuit can be operated at high speed.

Note that a MOS transistor, a bipolar transistor, and the like may be formed over one substrate. Thus, reduction in power consumption, reduction in size, high-speed operation, and the like can be achieved.

Furthermore, a variety of transistors can be used.

Note that a transistor can be formed using a variety of substrates, without limitation to a certain type. For example, a single crystal substrate, an SOI substrate, a glass substrate, a quartz substrate, a plastic substrate, a stainless steel substrate, a substrate including a stainless steel foil, or the like can be used as a substrate. Alternatively, the transistor may be formed using one substrate, and then, the transistor may be transferred to another substrate. As a substrate to which the transistor is transferred, a single crystal substrate, an SOI substrate, a glass substrate, a quartz substrate, a plastic substrate, a paper substrate, a cellophane substrate, a stone substrate, a wood substrate, a cloth substrate (including a natural fiber (e.g., silk, cotton, or hemp), a synthetic fiber (e.g., nylon, polyurethane, or polyester), a regenerated fiber (e.g., acetate, cupra, rayon, or regenerated polyester), or the like), a leather substrate, a rubber substrate, a stainless steel substrate, a substrate including a stainless steel foil, or the like can be used. A skin (e.g., epidermis or corium) or hypodermal tissue of an animal such as a human being can be used as a substrate to which the transistor is transferred. Alternatively, the transistor may be formed using one substrate and the substrate may be thinned by polishing. As a substrate to be polished, a single crystal substrate, an SOI substrate, a glass substrate, a quartz substrate, a plastic substrate, a stainless steel substrate, a substrate including a stainless steel foil, or the like can be used. By using such a substrate, a transistor with excellent properties or low power consumption can be formed, a device with high durability or high heat resistance can be provided, or reduction in weight or thickness can be achieved.

Note that the structure of a transistor can be a variety of structures, without limitation to a certain structure. For example, a multi-gate structure having two or more gate electrodes can be used. By using the multi-gate structure, a structure where a plurality of transistors are connected in series is provided because channel regions are connected in series. With the multi-gate structure, the amount of off-state current can be reduced, and the withstand voltage of the transistor can be increased (the reliability can be improved). Moreover, with the multi-gate structure, drain-source current does not fluctuate very much even when drain-source voltage fluctuates when the transistor operates in a saturation region, so that a flat slope of voltage-current characteristics can be obtained. By utilizing the flat slope of the voltage-current characteristics, an ideal current source circuit or an active load having an extremely large resistance can be realized. Accordingly, a differential circuit or a current mirror circuit having excellent properties can be realized.

As another example, a structure where gate electrodes are formed above and below a channel can be used. By using the structure where gate electrodes are formed above and below the channel, a channel region is increased, so that the amount of current can be increased. Alternatively, by using the structure where gate electrodes are formed above and below the channel, a depletion layer can be easily formed, so that subthreshold swing can be improved. Note that when the gate electrodes are formed above and below the channel, a structure where a plurality of transistors are connected in parallel is provided.

A structure where a gate electrode is formed above a channel region, a structure where a gate electrode is formed below a channel region, a staggered structure, an inverted staggered structure, a structure where a channel region is divided into a plurality of regions, or a structure where channel regions are connected in parallel or in series can be used. Moreover, a structure where a source electrode or a drain electrode overlaps with a channel region (or part thereof) can be used. By using the structure where the source electrode or the drain electrode overlaps with the channel region (or part thereof), unstable operation due to accumulation of electric charge in part of the channel region can be prevented. Alternatively, a structure where an LDD region is provided can be used. By the provision of the LDD region, the amount of off-state current can be reduced or the withstand voltage of the transistor can be increased (the reliability can be improved). Further, by the provision of the LDD region, drain-source current does not fluctuate very much even when drain-source voltage fluctuates when the transistor operates in the saturation region, so that a flat slope of voltage-current characteristics can be obtained.

Note that a variety of transistors can be used as a transistor, and the transistor can be formed using a variety of substrates. Accordingly, all the circuits which are necessary to realize a predetermined function can be formed using one substrate. For example, all the circuits which are necessary to realize the predetermined function can be formed using a glass substrate, a plastic substrate, a single crystal substrate, an SOI substrate, or any other substrate. When all the circuits which are necessary to realize the predetermined function are formed using one substrate, cost can be reduced by reduction in the number of components or the reliability can be improved by reduction in the number of connections to circuit components. Alternatively, some of the circuits which are necessary to realize the predetermined function can be formed using one substrate and some of the circuits which are necessary to realize the predetermined function can be formed using another substrate. That is, not all the circuits which are necessary to realize the predetermined function need to be formed using one substrate. For example, some of the circuits which are necessary to realize the predetermined function can be formed by transistors using a glass substrate, some of the circuits which are necessary to realize the predetermined function can be formed using a single crystal substrate, and an IC chip including transistors formed using the single crystal substrate can be connected to the glass substrate by COG (chip on glass) so that the IC chip is provided over the glass substrate. Alternatively, the IC chip can be connected to the glass substrate by TAB (tape automated bonding) or a printed wiring board. When some of the circuits are formed using the same substrate in this manner, cost can be reduced by reduction in the number of components or the reliability can be improved by reduction in the number of connections to circuit components. Moreover, circuits with high driving voltage and circuits with high driving frequency consume large power. Accordingly, such circuits may be formed using a single crystal substrate instead of using the same substrate and an IC chip formed by the circuits may be used, thereby preventing increase in power consumption, for example.

Note that a transistor is an element having at least three terminals of a gate, a drain, and a source. The transistor has a channel region between a drain region and a source region, and current can flow through the drain region, the channel region, and the source region. Here, since the source and the drain of the transistor change depending on the structure, the operating condition, and the like of the transistor, it is difficult to define which is a source or a drain. Thus, a region which serves as a source or a drain is not referred to as a source or a drain in some cases. In such a case, one of the source and the drain may be referred to as a first terminal and the other of the source and the drain may be referred to as a second terminal, for example. Alternatively, one of the source and the drain may be referred to as a first electrode and the other of the source and the drain may be referred to as a second electrode. Further alternatively, one of the source and the drain may be referred to as a first region and the other of the source and the drain may be referred to as a second region.

Note that a transistor may be an element having at least three terminals of a base, an emitter, and a collector. In this case also, the emitter and the collector may be referred to as a first terminal and a second terminal.

A gate corresponds to all or some of a gate electrode and a gate wiring (also referred to as a gate line, a gate signal line, a scan line, a scan signal line, or the like). A gate electrode corresponds to part of a conductive film which overlaps with a semiconductor forming a channel region with a gate insulating film therebetween. Note that part of the gate electrode sometimes overlaps with an LDD (lightly doped drain) region or a source region (or a drain region) with the gate insulating film therebetween. A gate wiring corresponds to a wiring for connecting gate electrodes of transistors to each other, a wiring for connecting gate electrodes of pixels to each other, or a wiring for connecting a gate electrode to another wiring.

Note that there is a portion (a region, a conductive film, a wiring, or the like) which serves as both a gate electrode and a gate wiring. Such a portion (a region, a conductive film, a wiring, or the like) may be referred to as either a gate electrode or a gate wiring. That is, there is a region in which a gate electrode and a gate wiring cannot be clearly distinguished from each other. For example, in the case where a channel region overlaps with part of an extended gate wiring, the overlapped portion (region, conductive film, wiring, or the like) serves as both a gate wiring and a gate electrode. Thus, such a portion (a region, a conductive film, a wiring, or the like) may be referred to as either a gate electrode or a gate wiring.

Note that a portion (a region, a conductive film, a wiring, or the like) which is formed using the same material as a gate electrode, forms the same island as the gate electrode, and is connected to the gate electrode may be referred to as a gate electrode. Similarly, a portion (a region, a conductive film, a wiring, or the like) which is formed using the same material as a gate wiring, forms the same island as the gate wiring, and is connected to the gate wiring may be referred to as a gate wiring. In a strict sense, such a portion (a region, a conductive film, a wiring, or the like) does not overlap with a channel region or does not have a function of connecting the gate electrode to another gate electrode in some cases. However, there is a portion (a region, a conductive film, a wiring, or the like) which is formed using the same material as a gate electrode or a gate wiring, forms the same island as the gate electrode or the gate wiring, and is connected to the gate electrode or the gate wiring because of specifications or the like in manufacturing. Thus, such a portion (a region, a conductive film, a wiring, or the like) may be referred to as either a gate electrode or a gate wiring.

Note that in a multi-gate transistor, for example, a gate electrode is often connected to another gate electrode by using a conductive film which is formed using the same material as the gate electrode. Since such a portion (a region, a conductive film, a wiring, or the like) is a portion (a region, a conductive film, a wiring, or the like) for connecting the gate electrode to another gate electrode, the portion may be referred to as a gate wiring, or the portion may be referred to as a gate electrode because a multi-gate transistor can be considered as one transistor. That is, a portion (a region, a conductive film, a wiring, or the like) which is formed using the same material as a gate electrode or a gate wiring, forms the same island as the gate electrode or the gate wiring, and is connected to the gate electrode or the gate wiring may be referred to as either a gate electrode or a gate wiring. Further, for example, part of a conductive film which connects the gate electrode and the gate wiring and is formed using a material which is different from that of the gate electrode or the gate wiring may be referred to as either a gate electrode or a gate wiring.

Note that a gate terminal corresponds to part of a portion (a region, a conductive film, a wiring, or the like) of a gate electrode or part of a portion (a region, a conductive film, a wiring, or the like) which is electrically connected to the gate electrode.

In the case where a wiring is referred to as a gate wiring, a gate line, a gate signal line, a scan line, a scan signal line, or the like, a gate of a transistor is not connected to the wiring in some cases. In this case, the gate wiring, the gate line, the gate signal line, the scan line, or the scan signal line sometimes corresponds to a wiring formed in the same layer as the gate of the transistor, a wiring formed using the same material as the gate of the transistor, or a wiring formed at the same time as the gate of the transistor. Examples are a wiring for a storage capacitor, a power supply line, and a reference potential supply line.

A source corresponds to all or some of a source region, a source electrode, and a source wiring (also referred to as a source line, a source signal line, a data line, a data signal line, or the like). A source region corresponds to a semiconductor region containing a large amount of p-type impurities (e.g., boron or gallium) or n-type impurities (e.g., phosphorus or arsenic). Therefore, a region containing a small amount of p-type impurities or n-type impurities, that is, an LDD (lightly doped drain) region is not included in the source region. A source electrode is part of a conductive layer which is formed using a material different from that of a source region and is electrically connected to the source region. Note that a source electrode and a source region are collectively referred to as a source electrode in some cases. A source wiring corresponds to a wiring for connecting source electrodes of transistors to each other, a wiring for connecting source electrodes of pixels to each other, or a wiring for connecting a source electrode to another wiring.

However, there is a portion (a region, a conductive film, a wiring, or the like) which serves as both a source electrode and a source wiring. Such a portion (a region, a conductive film, a wiring, or the like) may be referred to as either a source electrode or a source wiring. That is, there is a region in which a source electrode and a source wiring cannot be clearly distinguished from each other. For example, in the case where a source region overlaps with part of an extended source wiring, the overlapped portion (region, conductive film, wiring, or the like) serves as both a source wiring and a source electrode. Thus, such a portion (a region, a conductive film, a wiring, or the like) may be referred to as either a source electrode or a source wiring.

Note that a portion (a region, a conductive film, a wiring, or the like) which is formed using the same material as a source electrode, forms the same island as the source electrode, and is connected to the source electrode; or a portion (a region, a conductive film, a wiring, or the like) which connects a source electrode and another source electrode may be referred to as a source electrode. Further, a portion which overlaps with a source region may be referred to as a source electrode. Similarly, a region which is formed using the same material as a source wiring, forms the same island as the source wiring, and is connected to the source wiring may be referred to as a source wiring. In a strict sense, such a portion (a region, a conductive film, a wiring, or the like) does not have a function of connecting the source electrode to another source electrode in some cases. However, there is a portion (a region, a conductive film, a wiring, or the like) which is formed using the same material as a source electrode or a source wiring, forms the same island as the source electrode or the source wiring, and is connected to the source electrode or the source wiring because of specifications or the like in manufacturing. Thus, such a portion (a region, a conductive film, a wiring, or the like) may be referred to as either a source electrode or a source wiring.

For example, part of a conductive film which connects the source electrode and the source wiring and is formed using a material which is different from that of the source electrode or the source wiring may be referred to as either a source electrode or a source wiring.

A source terminal corresponds to part of a source region, part of a source electrode, or part of a portion (a region, a conductive film, a wiring, or the like) which is electrically connected to the source electrode.

In the case where a wiring is referred to as a source wiring, a source line, a source signal line, a data line, a data signal line, or the like, a source (a drain) of a transistor is not connected to the wiring in some cases. In this case, the source wiring, the source line, the source signal line, the data line, or the data signal line sometimes corresponds to a wiring formed in the same layer as the source (the drain) of the transistor, a wiring formed using the same material as the source (the drain) of the transistor, or a wiring formed at the same time as the source (the drain) of the transistor. Examples are a wiring for a storage capacitor, a power supply line, and a reference potential supply line.

Note that the same can be said for a drain.

Note that one pixel corresponds to one element whose brightness can be controlled. Therefore, for example, one pixel corresponds to one color element and brightness is expressed with the one color element. Accordingly, in that case, in the case of a color display device having color elements of R, G, and B, the minimum unit of an image is formed of three pixels of an R pixel, a G pixel, and a B pixel.

One feature of the structure described in this embodiment is that the wiring 108 for supplying the first potential and the wiring 109 for supplying the second potential, which are illustrated in FIG. 1, are connected to the plurality of pixels 105. A pixel including a circuit for compensating variation in threshold voltage of TFTs has a voltage program period and a light-emitting period as described above. In the light-emitting period, unlike the voltage program period, in the wirings 108 and 109 functioning as the wirings for supplying current, voltage drop occurs because of adverse effect of wiring resistance due to increase in length of the wiring; thus, voltages of the wirings for supplying current vary. In the structure in this embodiment, electrical connection of the wirings 108 and 109 functioning as the wirings for supplying current are switched in the voltage program period and the light-emitting period, so that adverse effect of voltage drop due to the wirings for supplying current can be reduced. The pixel will be described below using specific circuit configurations.

Figure 2A:
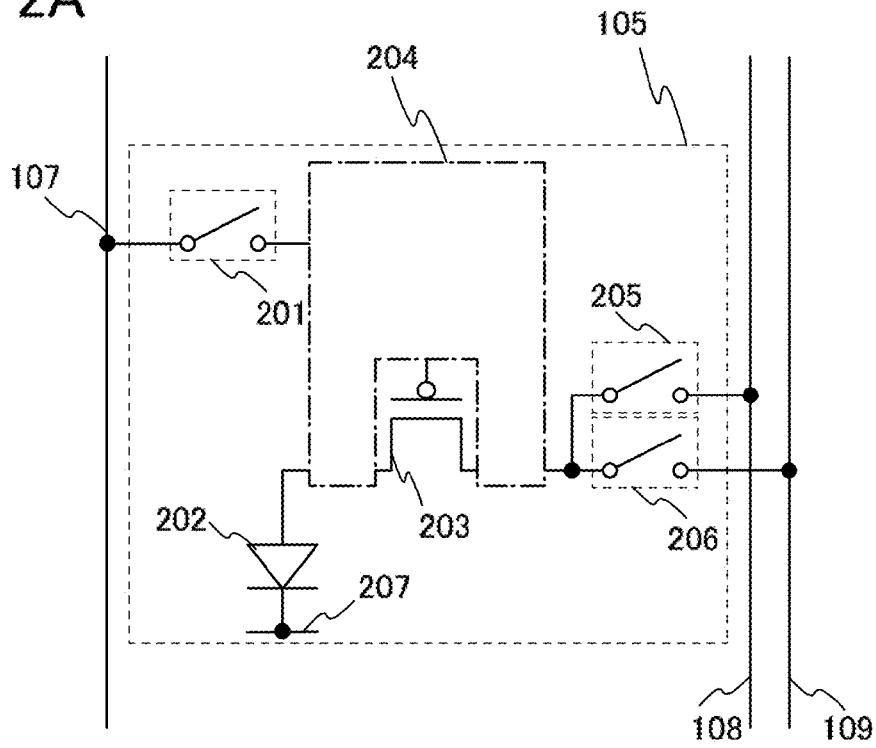
FIGS. 2A and 2B illustrate Embodiment 1.

First, a structure of the pixel 105 in FIG. 1 will be described. FIG. 2A is a circuit diagram in which the pixel 105 is connected to the wirings 107, 108, and 109. The pixel 105 includes a switch 201 (a selection switch) for taking a potential of the wiring 107 in the pixel with control by the wiring 106, a light-emitting element 202 whose gray level is controlled in accordance with the potential supplied from the wiring 107, a transistor 203 connected to one electrode of the light-emitting element 202 to drive the light-emitting element 202, a compensation circuit 204 for compensating the threshold voltage of the transistor 203 and maintaining video voltage applied to the transistor 203, a switch 205 (a first switch) for switching electrical connection between the wiring 108 and a first terminal of the transistor 203, and a switch 206 (a second switch) for switching electrical connection between the wiring 109 and the first terminal of the transistor 203. The other electrode of the light-emitting element 202 is connected to a wiring 207 (a third wiring) to which a potential for driving the light-emitting element is supplied.

Since control signals for controlling the switches 201, 205, and 206 in FIG. 2A may be supplied from an additional wiring or another wiring used in common, they are not particularly illustrated here. As an example, the case where the wiring 106 in FIG. 1 serves as a wiring for controlling the switch 201 is described below. The wiring for controlling the switches 205 and 206 may be arranged in parallel to the wiring 107 or to a gate line. Alternatively, the switches 205 and 206 may be controlled using a gate line connected to a pixel in another column. When the switches 205 and 206 are transistors with opposite polarities, a wiring for supplying signals for controlling the switches 205 and 206 can be used in common, so that the number of wirings can be reduced, which leads to reduction in cost, improvement in yield, and the like.

Moreover, the case where the transistor 203 for driving the light-emitting element 202 is a p-channel transistor is described in FIG. 2A. Note that the structure shown in this embodiment obtains similar effect when an n-channel transistor is used as the transistor 203 for driving the light-emitting element 202. In the case where an n-channel transistor is used as the transistor 203 for driving the light-emitting element 202, it is necessary to electrically connect the transistor 203 and the light-emitting element 202 in consideration of the polarity of the transistor. When the polarity of the transistor 203 is the same as that of a transistor included in the switch 201 and a transistor included in the compensation circuit 204, costs of manufacturing the display device can be reduced.

Note that the switches 205 and 206 may have the same or different capabilities of passing current. As a specific structure, when the switches 205 and 206 are formed using transistors, the transistors may have different W/L (where W is the channel width and L is the channel length of a transistor). Note that W/L of the switch 206 is preferably higher than that of the switch 205. The amount of current flowing through the wiring 109 is larger than that flowing through the wiring 108. Accordingly, it is preferable to make W/L of the switch 206 higher than that of the switch 205 because a larger amount of current can flow from the wiring 109 to the pixel 105.

Figure 2B:
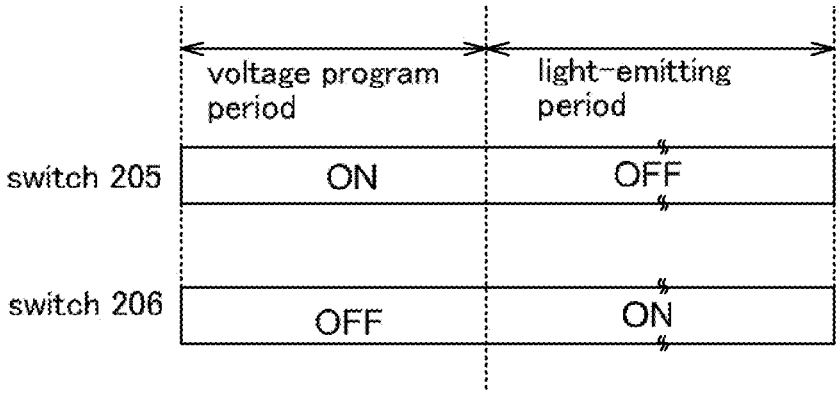

Next, a method for driving a pixel in a display device with the structure shown in this embodiment will be described. FIG. 2B illustrates operation of the switches 205 and 206 illustrated in FIG. 2A. As described above, the pixel 105 has a voltage program period and a light-emitting period. In the display device described in this embodiment, in the voltage program period, control is performed so that the switch 205 is turned on and the switch 206 is turned off. Moreover, in the light-emitting period, control is performed so that the switch 205 is turned off and the switch 206 is turned on.

Here, for describing the method for driving the pixel 105 in more detail, specific configurations of a pixel circuit are illustrated in FIGS. 3A and 3B and FIGS. 4A and 4B.

Figure 3A:
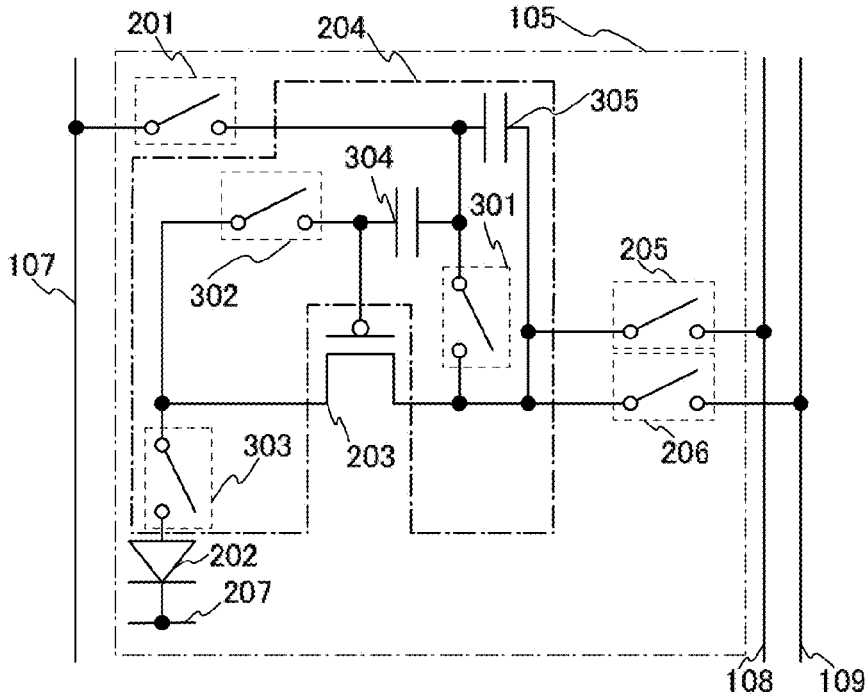
FIGS. 3A and 3B each illustrate Embodiment 1.

The configuration of the pixel circuit in FIG. 3A is an example of a circuit diagram of a pixel included in a display device, especially an example of the compensation circuit 204 in FIG. 2A. As in FIG. 2A, the pixel 105 is connected to the wirings 107, 108, and 109 and includes the switch 201, the light-emitting element 202, the transistor 203, the compensation circuit 204, the switch 205, and the switch 206. The compensation circuit 204 includes a switch 301 (a first control switch), a switch 302 (a second control switch), a switch 303 (a third control switch), a capacitor 304 (a first capacitor), and a capacitor 305 (a second capacitor).

Note that in this specification, switches are sometimes called a selection switch, a control switch, or simply a switch depending on their functions in order to avoid confusion of components. There is no limitation on the kind of switch as long as the switch can control electrical connection of its first terminal and second terminal.

Note that a variety of switches can be used as the switch. For example, an electrical switch or a mechanical switch can be used. That is, any element can be used as long as it can control a current flow, without limitation on a certain element. For example, a transistor (e.g., a bipolar transistor or a MOS transistor), or a diode (e.g., a PN diode, a PIN diode, a Schottky diode, an MIM (metal insulator metal) diode, an MIS (metal insulator semiconductor) diode, or a diode-connected transistor) can be used as the switch. Alternatively, a logic circuit in which such elements are combined can be used as the switch.

An example of a mechanical switch is a switch formed using a MEMS (micro electro mechanical system) technology, such as a digital micromirror device (DMD). Such a switch includes an electrode which can be moved mechanically, and operates by controlling conduction and non-conduction in accordance with movement of the electrode.

When a transistor is used as a switch, the polarity (conductivity type) of the transistor is not particularly limited to a certain type because it operates just as a switch. Note that a transistor having polarity with smaller off-state current is preferably used when the amount of off-state current is to be suppressed. Examples of a transistor with smaller off-state current are a transistor provided with an LDD region, and a transistor with a multi-gate structure. Further, an n-channel transistor is preferably used when a potential of a source terminal of the transistor which is operated as a switch is close to a potential of a low-potential-side power supply (e.g., Vss, GND, or 0 V). On the other hand, a p-channel transistor is preferably used when the potential of the source terminal is close to a potential of a high-potential-side power supply (e.g., Vdd). This is because the absolute value of gate-source voltage can be increased when the potential of the source terminal of the n-channel transistor is close to a potential of a low-potential-side power supply and when the potential of the source terminal of the p-channel transistor is close to a potential of a high-potential-side power supply, so that the transistor can be operated more accurately as a switch. This is also because the transistor does not often perform source follower operation, so that reduction in output voltage does not often occur.

Note that a CMOS switch may be used as the switch by using both an n-channel transistor and a p-channel transistor. By using a CMOS switch, the switch can be more accurately operated as the switch because current can flow when either the p-channel transistor or the n-channel transistor is turned on. For example, voltage can be appropriately output regardless of whether voltage of an input signal to the switch is high or low. Moreover, since the voltage amplitude value of a signal for turning on or off the switch can be made smaller, power consumption can be reduced.

Note that when a transistor is used as the switch, the switch includes an input terminal (one of a source terminal and a drain terminal), an output terminal (the other of the source terminal and the drain terminal), and a terminal for controlling conduction (a gate terminal). On the other hand, when a diode is used as the switch, the switch does not include a terminal for controlling conduction in some cases. Therefore, when a diode is used as the switch, the number of wirings for controlling terminals can be reduced as compared to the case of using a transistor.

In FIG. 3A, a first terminal of the switch 201, a first terminal of the switch 301, one electrode of the capacitor 304, and one electrode of the capacitor 305 are connected to each other. Moreover, a second terminal of the switch 301, the first terminal of the transistor 203, the other electrode of the capacitor 305, a first terminal of the switch 205, and a first terminal of the switch 206 are connected to each other. The other electrode of the capacitor 304, a first terminal of the switch 302, and a gate terminal of the transistor 203 are connected to each other. A second terminal of the switch 302, a second terminal of the transistor 203, and a first terminal of the switch 303 are connected to each other. Further, a second terminal of the switch 303 is connected to an anode of the light-emitting element 202.

Figure 3B:
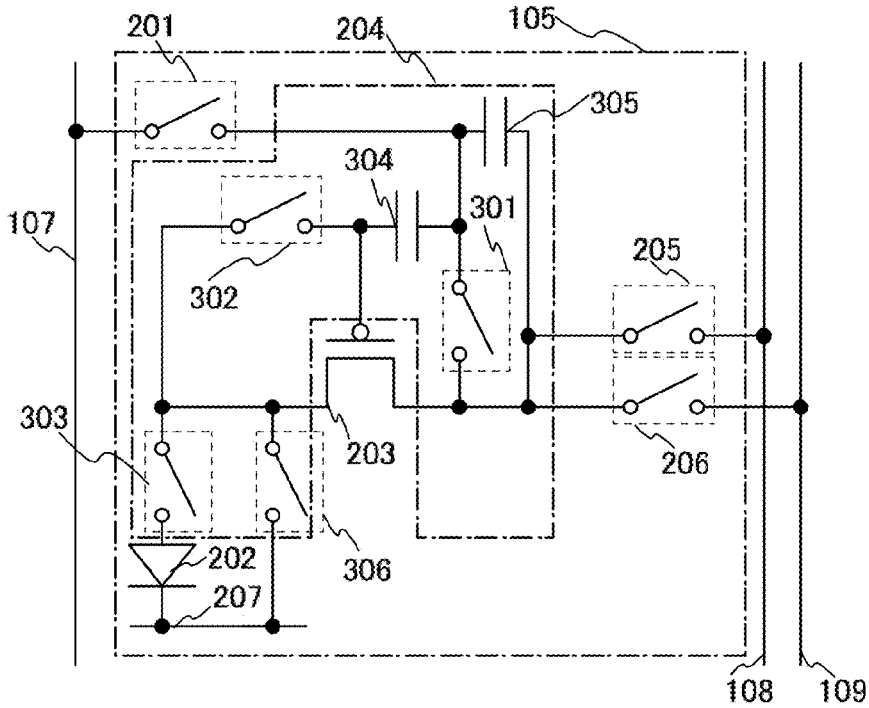

FIG. 3B illustrates the configuration of the pixel circuit in which a switch 306 (a fourth control switch) is provided in parallel with the switch 303 and the light-emitting element 202 in the example of the compensation circuit 204 illustrated in FIG. 3A. As in FIG. 3A, the pixel 105 in FIG. 3B is connected to the wirings 107, 108, and 109 and includes the switch 201, the light-emitting element 202, the transistor 203, the compensation circuit 204, the switch 205, and the switch 206. The compensation circuit 204 includes the switch 301, the switch 302, the switch 303, the capacitor 304, the capacitor 305, and the switch 306.

The configuration in FIG. 3B is different from the configuration in FIG. 3A in that the second terminal of the switch 302, the second terminal of the transistor 203, the first terminal of the switch 303, and a first terminal of the switch 306 are connected to each other, and a second terminal of the switch 306 is connected to the wiring 207.

Figure 4A:
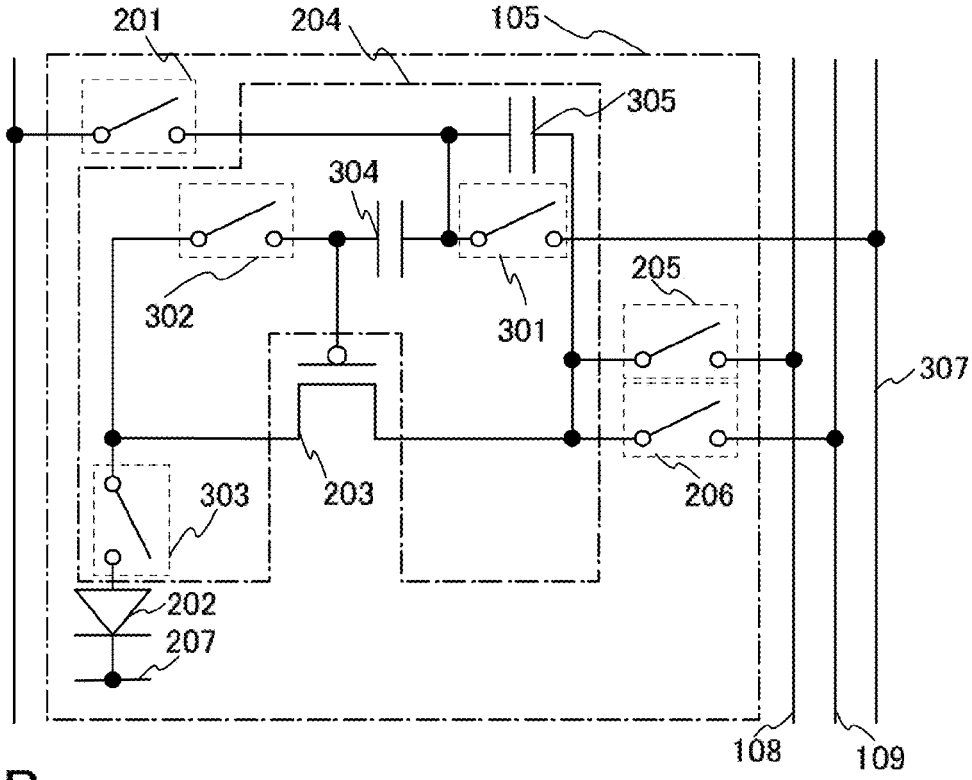
FIGS. 4A and 4B each illustrate Embodiment 1.

A feature of the configuration of the pixel circuit illustrated in FIG. 4A lies in that the second terminal of the switch 301 is connected to a wiring 307 (a fourth wiring) which is additionally provided in the example of the compensation circuit 204 illustrated in FIG. 3A. The pixel 105 in FIG. 4A is connected to the wirings 107, 108, 109, and 307 and includes the switch 201, the light-emitting element 202, the transistor 203, the compensation circuit 204, the switch 205, and the switch 206. The compensation circuit 204 includes the switch 301, the switch 302, the switch 303, the capacitor 304, and the capacitor 305.

The configuration in FIG. 4A is different from the configuration in FIG. 3A in that the second terminal of the switch 301 is not connected to the first terminal of the transistor 203, the other electrode of the capacitor 305, the first terminal of the switch 205, and the first terminal of the switch 206, and is connected to the wiring 307 which is additionally provided.

Figure 4B:
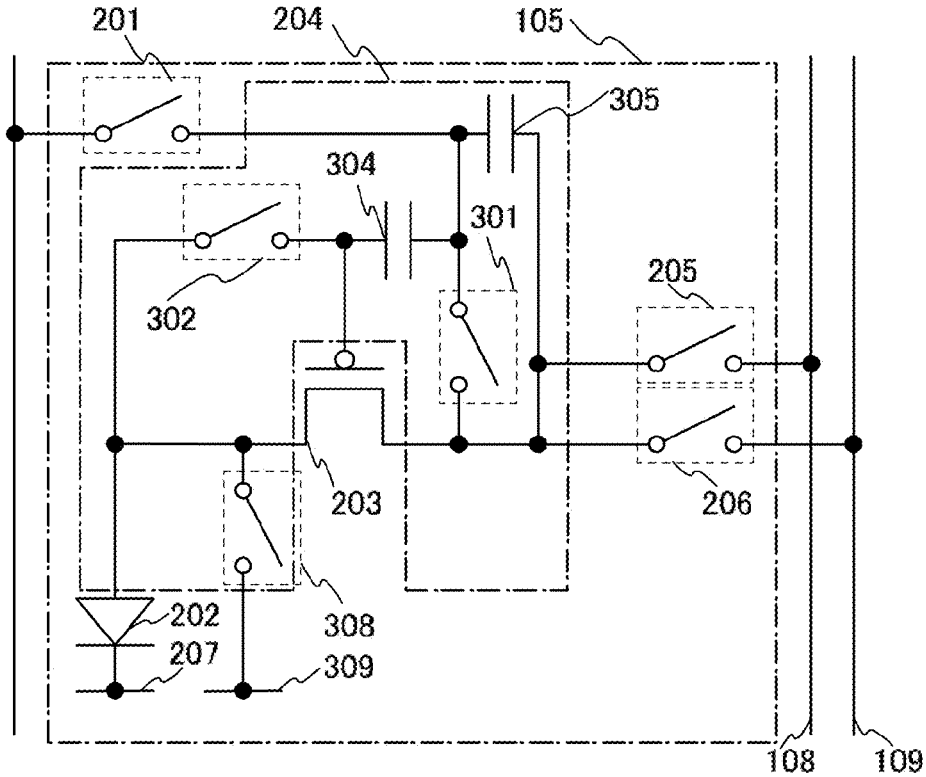

FIG. 4B illustrates the configuration of the pixel circuit in which the switch 303 is not provided and a second terminal of a switch 308 is connected to a wiring 309 (a fifth wiring) in the example of the compensation circuit 204 illustrated in FIG. 3B. The pixel 105 in FIG. 4B is connected to the wirings 107, 108, 109, and 309 and includes the switch 201, the light-emitting element 202, the transistor 203, the compensation circuit 204, the switch 205, and the switch 206. The compensation circuit 204 includes the switch 301, the switch 302, the capacitor 304, the capacitor 305, and the switch 308.

The configuration in FIG. 4B is different from the configuration in FIG. 3B in that the second terminal of the transistor 203 is directly connected to the anode of the light-emitting element 202 and a first terminal of the switch 308 without the provision of the switch 303, and the second terminal of the switch 308 is connected to the wiring 309.

Next, the operation principle of the circuits illustrated in FIGS. 3A and 3B and FIGS. 4A and 4B will be described with reference to FIGS. 5A and 5B and FIGS. 6A and 6B.

FIGS. 5A and 5B and FIGS. 6A and 6B illustrate elements corresponding to the wiring 108, the wiring 109, the wiring 207 (or the wiring 309), the transistor 203, the switch 301, the switch 302, the switch 303 (or the switch 308), the capacitor 304, the capacitor 305, the switch 205, and the switch 206 in the circuits illustrated in FIGS. 3A and 3B and FIGS. 4A and 4B. A first potential supplied to the wiring 108 is represented as $V_1$, and a second potential supplied to the wiring 109 is represented as $V_2$. A ground potential supplied to the wiring 207 is represented as $V_{GND}$ (=0 V). Note that although not illustrated for simplification, the pixel also includes other elements such as a control switch and a light-emitting element. Note that the case is described in which the relation of the level of the potentials is $V_2>V_1>>V_{GND}$, and the threshold voltage of the transistor 203, which is a p-channel transistor, is −Vth. When the gate-source voltage of the transistor 203 is represented as Vgs, the transistor 203 is on in the case where Vgs<−Vth and the transistor 203 is off in the case where Vgs≧−Vth.

Note that voltage described in this specification corresponds to the potential difference when the ground potential $V_{GND}$ is a reference potential of 0 V. Accordingly, voltage is referred to as potential or potential is referred to as voltage in some cases.

Figure 5A:
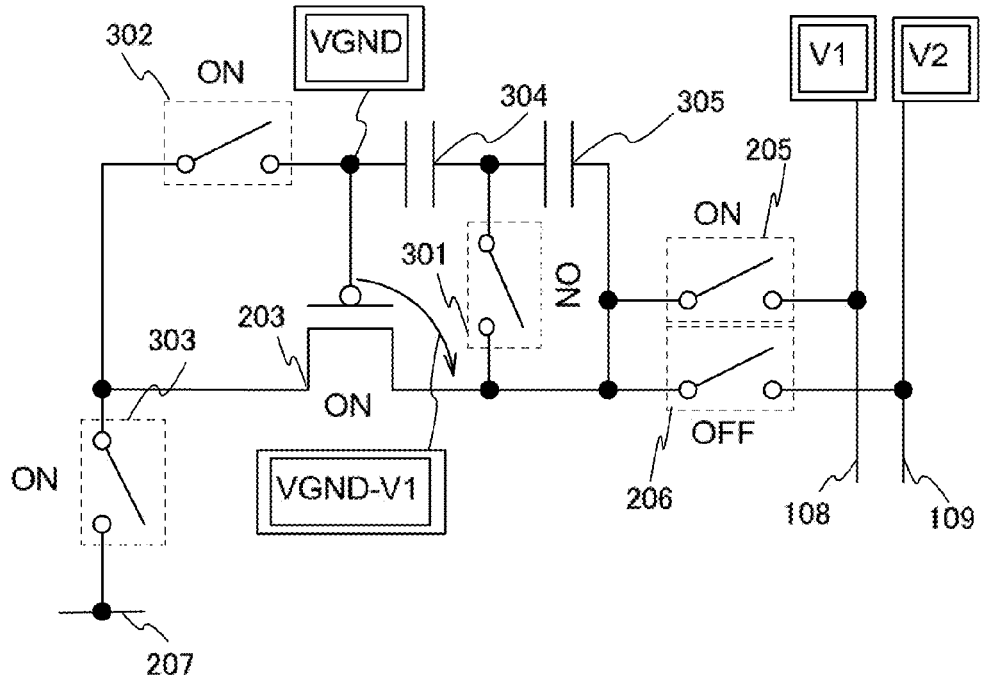
FIGS. 5A and 5B illustrate Embodiment 1.

First, as illustrated in FIG. 5A, the switch 205 is turned on, the switch 206 is turned off, the switch 301 is turned on, the switch 302 is turned on, and the switch 303 is turned on. Accordingly, a potential of the gate terminal (hereinafter referred to as a gate potential) of the transistor 203 becomes $V_{GND}$, and a potential of the first terminal serving as the source (hereinafter referred to as a source potential) of the transistor 203 becomes $V_1$. Then, $(V_{GND}-V_1)$ is applied as Vgs, whereby it follows that $(V_{GND}-V_1)<-Vth$, and the transistor 203 is turned on.

Note that in the circuit configurations illustrated in FIG. 3B and FIGS. 4A and 4B, current can be prevented from flowing towards the light-emitting element at the state in FIG. 5A. Accordingly, in the display device, the contrast in the display portion can be improved.

Figure 5B:
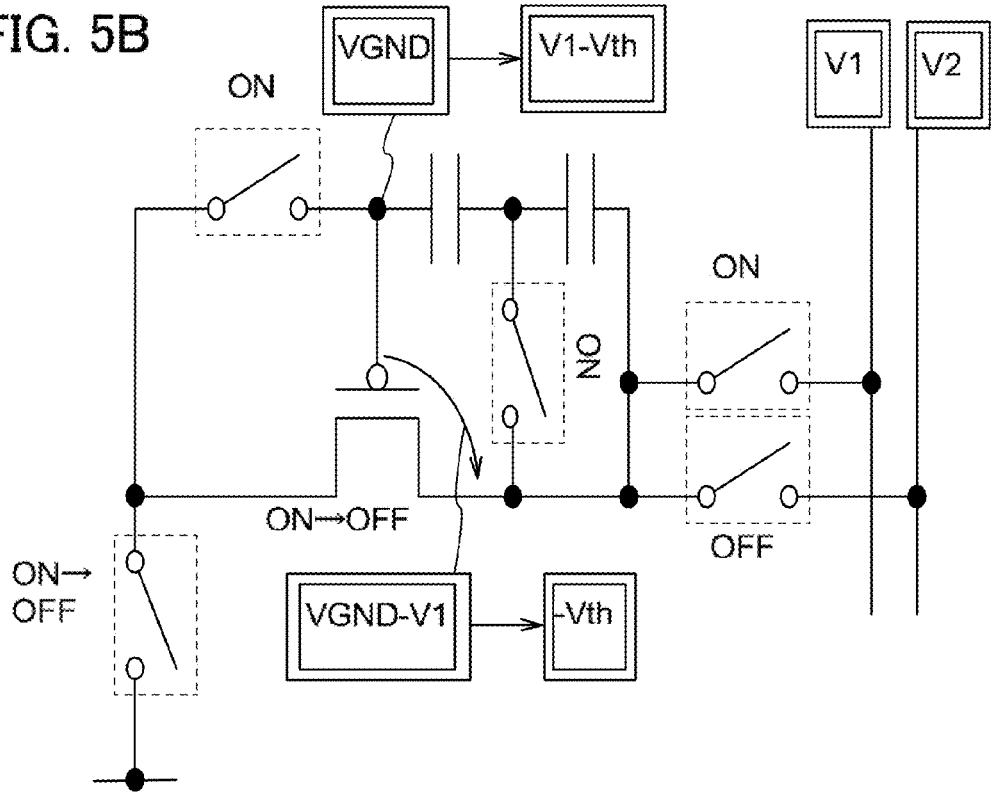

Next, as illustrated in FIG. 5B, the switch 303 is turned off. Accordingly, the gate potential becomes $(V_1-Vth)$, which is the value reduced from the first potential $V_1$ by the threshold voltage of the transistor 203. Then, the amount of current flowing to the transistor 203 is reduced, and after a while, Vgs of the transistor 203 reaches −Vth, which is the threshold voltage, so that the transistor 203 is turned off. After that, −Vth is held between the gate and the source of the transistor 203 even when the switches 301 and 302 are turned off.

Figure 6A:
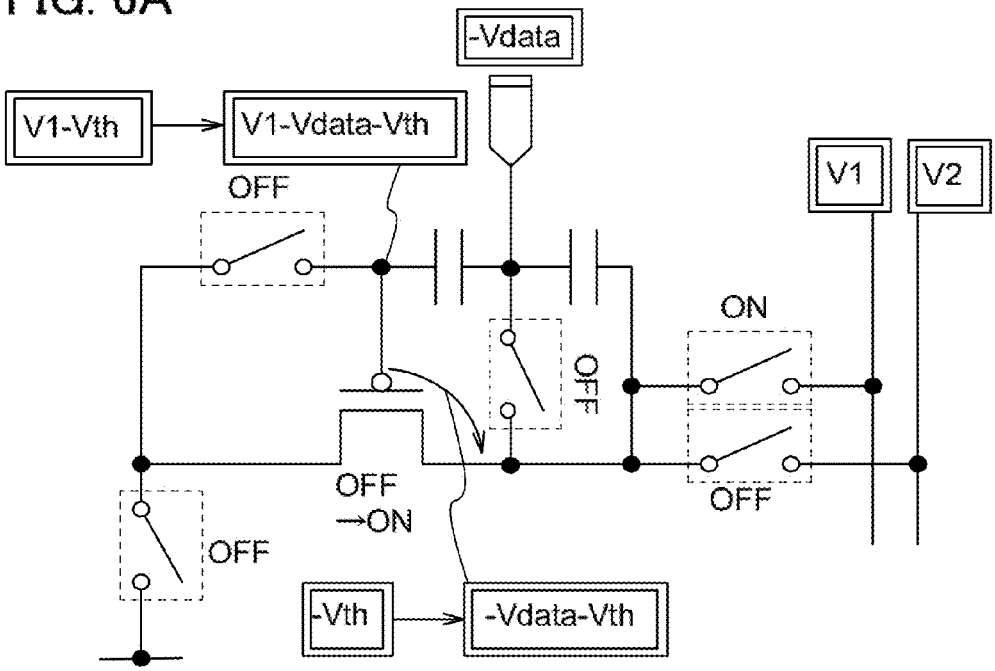
FIGS. 6A and 6B illustrate Embodiment 1.

Next, as illustrated in FIG. 6A, the switches 301 and 302 are turned off, and video voltage $-V_{data}$ is applied to a node to which the first terminal of the switch 301, one electrode of the capacitor 304, and one electrode of the capacitor 305 are connected. Note that since the transistor 203 is a p-channel transistor, the video voltage in FIG. 6A is $-V_{data}$. By the application of the video voltage $-V_{data}$, the gate potential of the transistor 203 becomes $(V_1-V_{data}-Vth)$. Moreover, the source potential of the transistor 203 becomes $V_1$, which is the same potential as the wiring 108. Accordingly, $(-V_{data}-Vth)$ is applied as Vgs of the transistor 203, whereby it follows that $(-V_{data}-Vth)<-Vth$, and the transistor 203 is turned on. Note that when $-V_{data}$ is 0, a black image is displayed, and the transistor 203 is off.

Note that before the gate potential reaches $(V_1-Vth)$, which is the value reduced from the first potential $V_1$ by the threshold voltage of the transistor 203 in FIG. 5B, the switches 301 and 302 illustrated in FIG. 6A may be turned off. By turning off the switches 301 and 302 before the gate potential reaches $(V_1-Vth)$, the mobility of the transistors 203 can be compensated among pixels. Accordingly, the display quality can be improved.

The above operation illustrated in FIGS. 5A and 5B and FIG. 6A corresponds to the voltage program period.

Figure 6B:
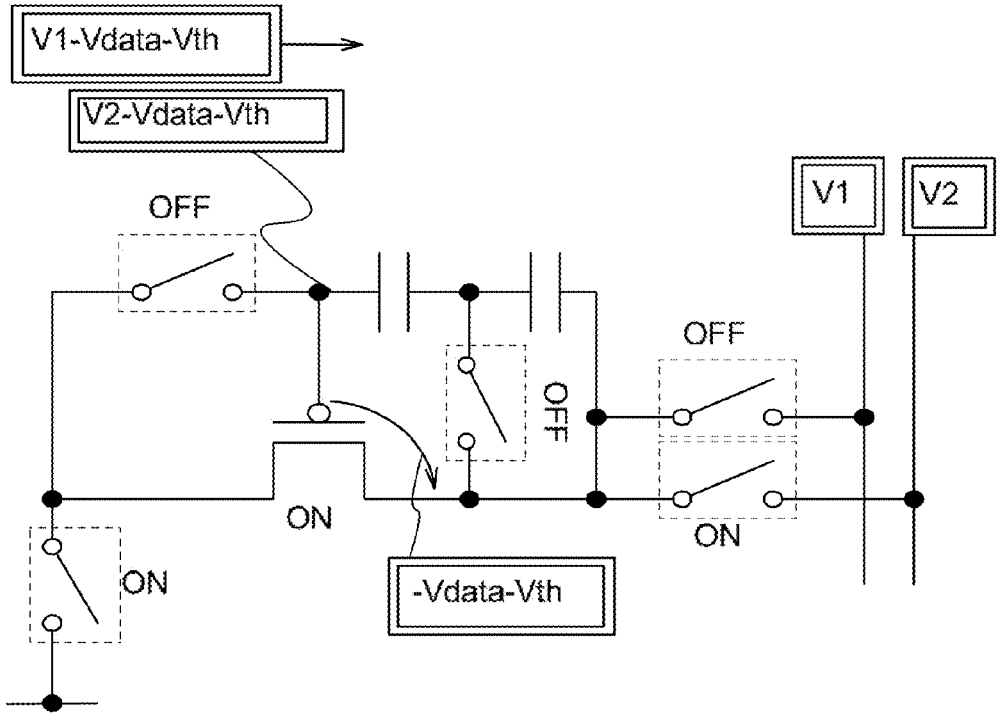

Next, as illustrated in FIG. 6B, on and off of the switches 205 and 206 are switched, and the switch 303 is turned off. The source potential of the transistor 203 becomes $V_2$, which is the same potential as the wiring 109. Moreover, since electric charge is not moved, the gate potential of the transistor 203 becomes $(V_2-V_{data}-Vth)$ due to capacitive coupling of the capacitors 304 and 305. Accordingly, $(-V_{data}-Vth)$ is applied as Vgs of the transistor 203, whereby it follows that $(-V_{data}-Vth)<-Vth$, so that the transistor 203 is turned on. Then, current flows through the switch 303 towards the wiring 207 to which the light-emitting element is connected. That is, Vgs of the transistor 203 can be applied in consideration of variation in threshold voltage Vth among transistors. Note that when $-V_{data}$ is 0, the transistor 203 is turned off, and the light-emitting element does not emit light.

The above operation illustrated in FIG. 6B corresponds to the light-emitting period.

Thus, the light-emitting element connected to the second terminal of the transistor 203 can be driven with the compensated threshold voltage of the transistor 203.

Note that FIGS. 5A and 5B and FIGS. 6A and 6B illustrate an example of the circuit in which a p-channel transistor is used as the transistor 203 and an example of potentials input and output based on the polarity of the transistor 203. This embodiment is not limited thereto, and when an n-channel transistor is used as the transistor 203, the n-channel transistor may be driven in a similar manner to the above-described operation of the transistor 203.

Figure 7A:
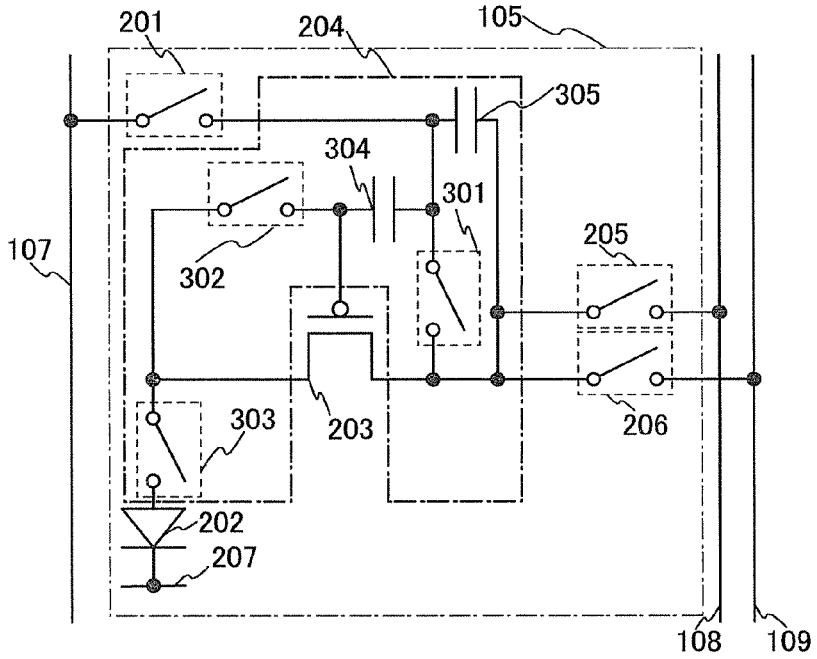
FIGS. 7A and 7B illustrate Embodiment 1.
Figure 7B:
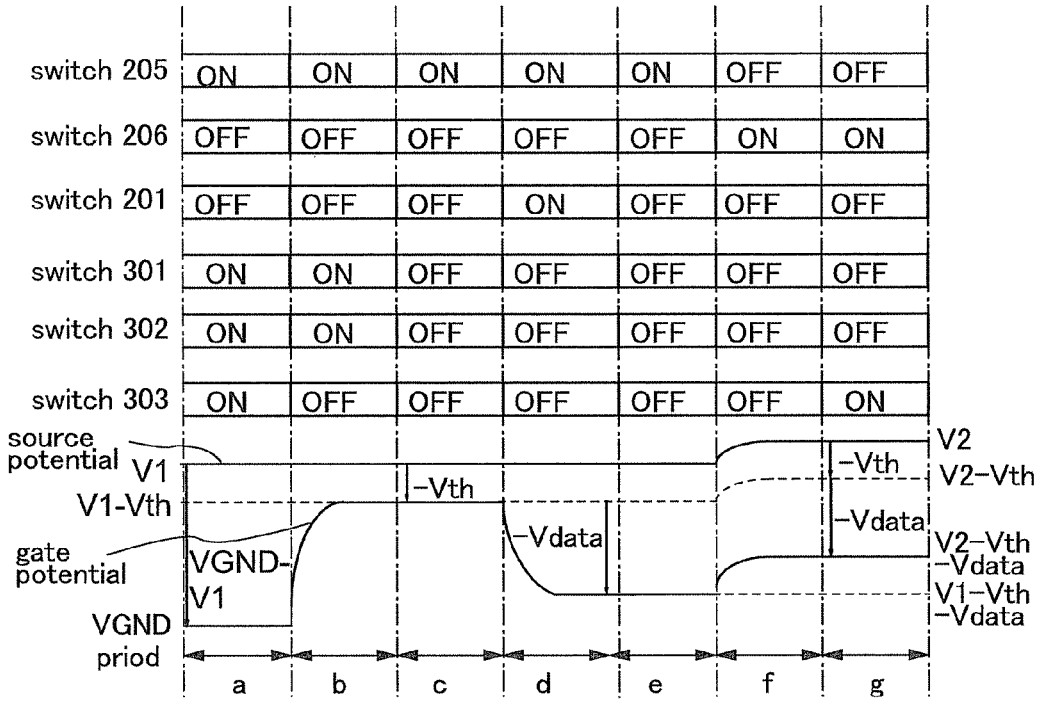

Next, circuit operation of the pixel in the display device will be specifically described with reference to FIGS. 7A and 7B and FIGS. 8A and 8B. Note that the circuit and on and off of the switches are illustrated in FIGS. 7A and 7B for specifically describing the above-described circuit operation illustrated in FIGS. 5A and 5B and FIGS. 6A and 6B by using the circuit diagram of FIG. 3A. Moreover, the circuit and on and off of the switches are illustrated in FIGS. 8A and 8B for specifically describing the circuit in the case where switching of the switches 205 and 206 illustrated in FIG. 7A is not performed and only the switch 205 is always on so that only the wiring 108 is connected to the transistor 203, as a comparative example for specifically describing advantageous effect of the structure shown in this embodiment.

FIG. 7A is the circuit diagram using reference numerals as in FIG. 3A. FIG. 7B illustrates switching of on and off of the switches 205, 206, 201, 301, 302, and 303 in periods a to g and change of the source potential and the gate potential of the transistor 203. Note that the source potential of the transistor 203 corresponds to a potential at which the first terminal of the transistor 203 is connected to the first terminals of the switches 205 and 206.

Figure 8A:
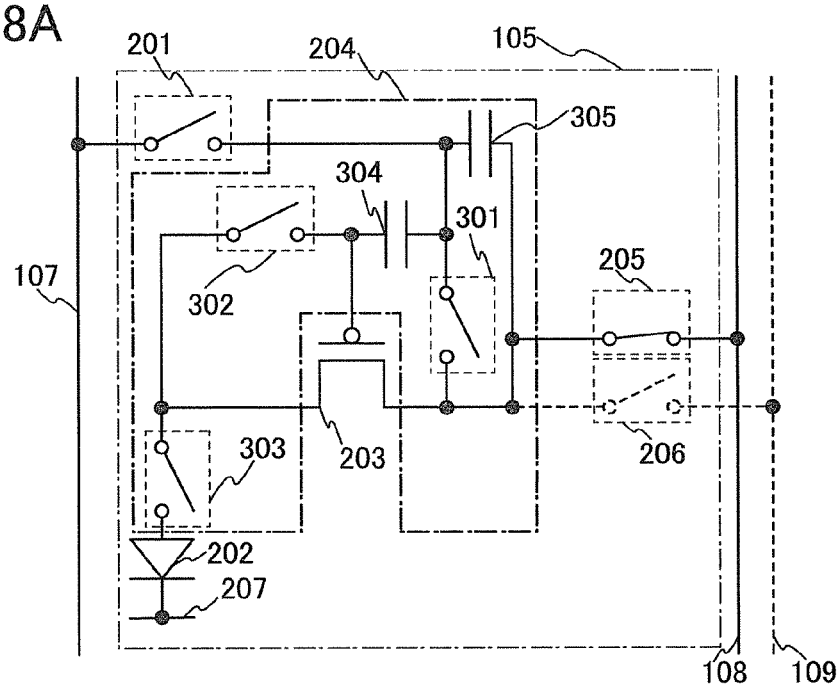
FIGS. 8A and 8B illustrate Embodiment 1.
Figure 8B:
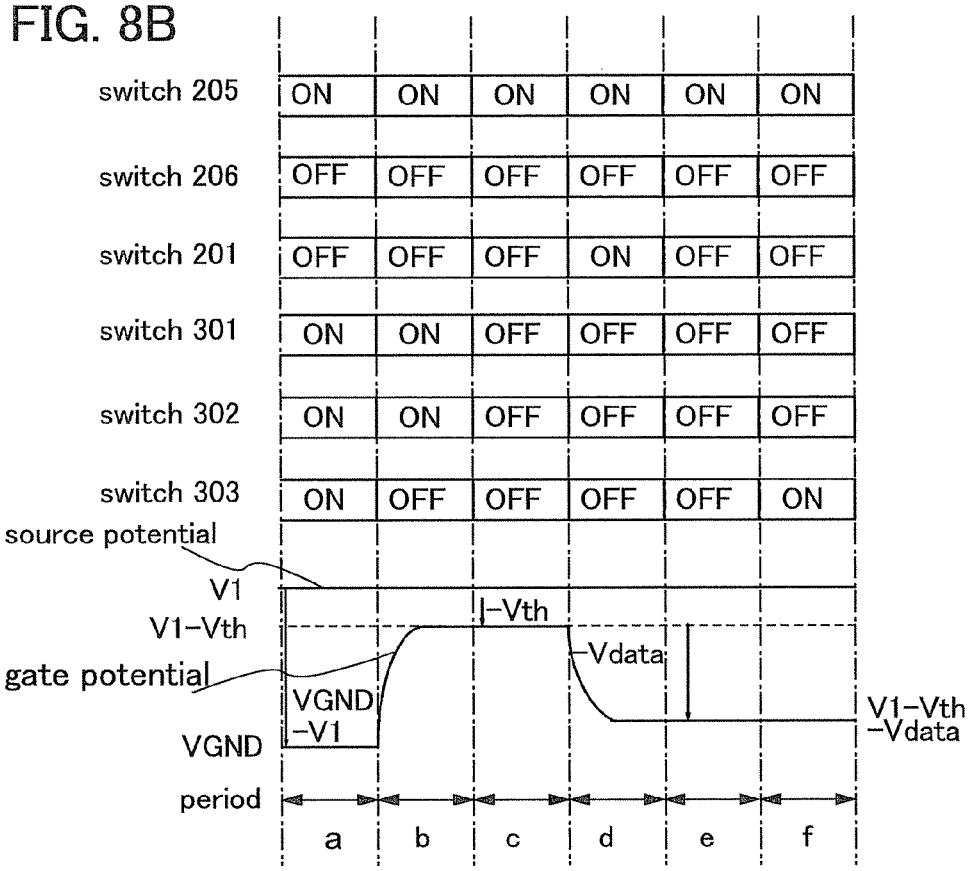

FIGS. 7A and 8A each illustrate a circuit configuration of the pixel 105 illustrated in FIG. 3A, which is connected to the wirings 107, 108, and 109 and includes the switch 201, the light-emitting element 202, the transistor 203, the compensation circuit 204, the switch 205, and the switch 206. The compensation circuit 204 includes the switch 301, the switch 302, the switch 303, the capacitor 304, and the capacitor 305. Note that electrical connection of the elements is similar to that in the description of FIG. 3A. In FIGS. 7A and 8A, the first potential supplied to the wiring 108 is represented as $V_1$, and the second potential supplied to the wiring 109 is represented as $V_2$. A ground potential supplied to the wiring 207 is represented as $V_{GND}$(=0 V), and video voltage supplied from the wiring 107 is represented by $-V_{data}$. Note that although not illustrated for simplification, the pixel 105 also includes other elements such as a control switch and a light-emitting element. Note that the case is described in which the relation of the level of the potentials is $V_2>V_1>>V_{GND}$, and the threshold voltage of the transistor 203, which is a p-channel transistor, is −Vth. When the gate-source voltage of the transistor 203 is represented as Vgs, the transistor is on in the case where Vgs<−Vth and the transistor is off in the case where Vgs≧−Vth. Note that $-V_{data}$ varies depending on an image to be displayed.

First, the switch 205 is turned on, the switch 206 is turned off, the switch 201 is turned off, and the switches 301 to 303 are turned on (in the period a in FIG. 7B). In the period a, the source potential of the transistor 203 is $V_1$, and the gate potential of the transistor 203 is $V_{GND}$. The potential difference between the gate and the source of the transistor 203 is ($V_{GND}-V_1$). Further, the transistor 203 is turned on in the period a.

Next, the switch 205 remains on, the switch 206 remains off, the switch 201 remains off, the switch 301 remains on, the switch 302 remains on, and the switch 303 is turned off (in the period b in FIG. 7B). In the period b, the source potential of the transistor 203 is $V_1$, and the gate potential of the transistor 203 becomes ($V_1$−Vth). The gate potential of the transistor 203 is increased because the transistor 203 is on in the period a and the switch 303 is turned off in the period b, so that the gate potential of the transistor 203 becomes the voltage obtained by subtracting the threshold voltage Vth of the transistor 203 from the potential $V_1$ of the wiring 108. The potential difference between the gate and the source of the transistor 203 is −Vth. Further, the transistor 203 is turned off in the period b.

Next, the switch 205 remains on, the switch 206 remains off, the switch 201 remains off, the switches 301 and 302 are turned off, and the switch 303 remains off (in the period c in FIG. 7B). In the period c, the source potential of the transistor 203 is $V_1$, and the gate potential of the transistor 203 is ($V_1$−Vth). That is, the voltage Vgs in the period b is maintained. Further, the transistor 203 is off in the period c.

Next, the switch 205 remains on, the switch 206 remains off, the switch 201 is turned on, and the switches 301 to 303 remain off (in the period d in FIG. 7B). In the period d, the source potential of the transistor 203 is $V_1$, and the gate potential of the transistor 203 becomes ($V_1$−Vth−$V_{data}$). The potential difference between the gate and the source of the transistor 203 is (−Vth−$V_{data}$). That is, Vgs obtained by adding the video signal $-V_{data}$ to the threshold voltage −Vth can be applied to the transistor 203. It is important that the first potential $V_1$ is not changed in the period d of FIG. 7B. This is because if the first potential $V_1$ is changed when the switch 201 is on, the amount of electric charge held in the capacitor 305 is changed, and Vgs of the transistor 203 cannot be maintained.

Next, the switch 205 remains on, the switch 206 remains off, the switch 201 is turned off, and the switches 301 to 303 remain off (in the period e in FIG. 7B). In the period e, the source potential of the transistor 203 is $V_1$, and the gate potential of the transistor 203 is ($V_1$−Vth−$V_{data}$). In other words, the voltage Vgs in the period d is maintained, and the potential difference between the gate and the source of the transistor 203 is (−Vth−$V_{data}$). That is, Vgs obtained by adding the video signal $-V_{data}$ to the threshold voltage −Vth can be applied to the transistor 203. Note that in the period e, the transistor 203 is off in the case where $-V_{data}$ is 0, and is on in response to $-V_{data}$ in the other cases.

The above operation in the periods a to e in FIG. 7B corresponds to the voltage program period.

Next, the switch 205 is turned off, the switch 206 is turned on, the switch 201 remains off, and the switches 301 to 303 remain off (in the period f in FIG. 7B). In the period f, Vgs in the period e is maintained due to capacitive coupling. Accordingly, on and off of the switches 205 and 206 are switched, and the gate potential of the transistor 203 becomes ($V_2$−Vth−$V_{data}$) when the source potential of the transistor 203 is $V_2$. That is, Vgs obtained by adding the video signal $-V_{data}$ to the threshold voltage −Vth can be applied to the transistor 203. Note that in the period f, the transistor 203 is off in the case where $-V_{data}$ is 0, and is on in response to $-V_{data}$ in the other cases.

Next, the switch 205 remains off, the switch 206 remains on, the switch 201 remains off, the switches 301 and 302 remain off, and the switch 303 is turned on (in the period g in FIG. 7B). In the period g, Vgs in the period f is maintained. Accordingly, the source potential of the transistor 203 is $V_2$, and the gate potential of the transistor 203 is ($V_2$−Vth−$V_{data}$). That is, Vgs obtained by adding the video signal $-V_{data}$ to the threshold voltage −Vth can be applied to the transistor 203. Then, current with compensated variation in threshold voltage among the transistors in pixels can flow to the light-emitting element 202. Note that in the period g, the transistor 203 is off in the case where $-V_{data}$ is 0, and no current flows to the light-emitting element 202.

The above operation in the periods f and g in FIG. 7B corresponds to the light-emitting period.

FIGS. 8A and 8B will be described. In the circuit diagram illustrated in FIG. 8A, the same portions or portions having similar functions to those in FIG. 7A are denoted by the same reference numerals. FIGS. 8A and 8B illustrate a structure in which the source potential of the transistor 203 is not switched between the first potential $V_1$ and the second potential $V_2$ by switching the switches 205 and 206. Accordingly, the following description of FIG. 8B is made on the case where the switch 205 is always on and the switch 206 is always off. Note that in FIG. 8A, the switch 206 and the wiring 109 are shown by dotted lines in order to indicate that the switch 206 is off and the wiring 109 is not connected to the pixel.

First, the switch 201 is turned off, and the switches 301 to 303 are turned on (in the period a in FIG. 8B). In the period a, the source potential of the transistor 203 is $V_1$, and the gate potential of the transistor 203 is $V_{GND}$. The potential difference between the gate and the source of the transistor 203 is ($V_{GND}-V_1$). Further, the transistor 203 is turned on in the period a.

Next, the switch 201 remains off, the switch 301 remains on, the switch 302 remains on, and the switch 303 is turned off (in the period b in FIG. 8B). In the period b, the source potential of the transistor 203 is $V_1$, and the gate potential of the transistor 203 becomes ($V_1$−Vth). The gate potential of the transistor 203 is increased because the transistor 203 is on in the period a and the switch 303 is turned off in the period b, so that the gate potential of the transistor 203 becomes the voltage obtained by subtracting the threshold voltage Vth of the transistor 203 from the potential $V_1$ of the wiring 108. The potential difference between the gate and the source of the transistor 203 is −Vth. Further, the transistor 203 is turned off in the period b.

Next, the switch 201 remains off, the switches 301 and 302 are turned off, and the switch 303 remains off (in the period c in FIG. 8B). In the period c, the source potential of the transistor 203 is $V_1$, and the gate potential of the transistor 203 is ($V_1$−Vth). That is, the voltage Vgs in the period b is maintained. Further, the transistor 203 is off in the period c.

Next, the switch 201 is turned on, and the switches 301 to 303 remain off (in the period d in FIG. 8B). In the period d, the source potential of the transistor 203 is $V_I$, and the gate potential of the transistor 203 becomes ($V_1$−Vth−$V_{data}$). The potential difference between the gate and the source of the transistor 203 is (−Vth−$V_{data}$). That is, Vgs obtained by adding the video signal −$V_{data}$ to the threshold voltage −Vth can be applied to the transistor 203. It is important that the first potential $V_1$ is not changed in the period d of FIG. 8B. This is because if the first potential $V_1$ is changed when the switch 201 is on, the amount of electric charge held in the capacitor 305 is changed, and Vgs of the transistor 203 cannot be maintained.

Next, the switch 201 is turned off, and the switches 301 to 303 remain off (in the period e in FIG. 8B). In the period e, the source potential of the transistor 203 is $V_1$, and the gate potential of the transistor 203 is ($V_1$−Vth−$V_{data}$), so that the potential difference (−Vth−$V_{data}$) between the gate and the source of the transistor 203 in the period d is maintained. That is, Vgs obtained by adding the video signal −$V_{data}$ to the threshold voltage −Vth can be applied to the transistor 203. Note that in the period e, the transistor 203 is off in the case where −$V_{data}$ is 0, and is on in response to −$V_{data}$ in the other cases.

The above operation in the periods a to e in FIG. 8B corresponds to the voltage program period.

Next, the switch 201 remains off, the switches 301 and 302 remain off, and the switch 303 is turned on (in the period f in FIG. 8B). In the period f, Vgs in the period e is maintained. Accordingly, the source potential of the transistor 203 is $V_1$, and the gate potential of the transistor 203 is ($V_1$−Vth−$V_{data}$). That is, Vgs obtained by adding the video signal −$V_{data}$ to the threshold voltage −Vth can be applied to the transistor 203. Then, current with compensated variation in threshold voltage among the transistors 203 in pixels can flow to the light-emitting element 202. Note that in the period f, the transistor 203 is off in the case where −$V_{data}$ is 0, and no current flows to the light-emitting element 202.

The above operation in the period f in FIG. 8B corresponds to the light-emitting period.

Figure 9B:
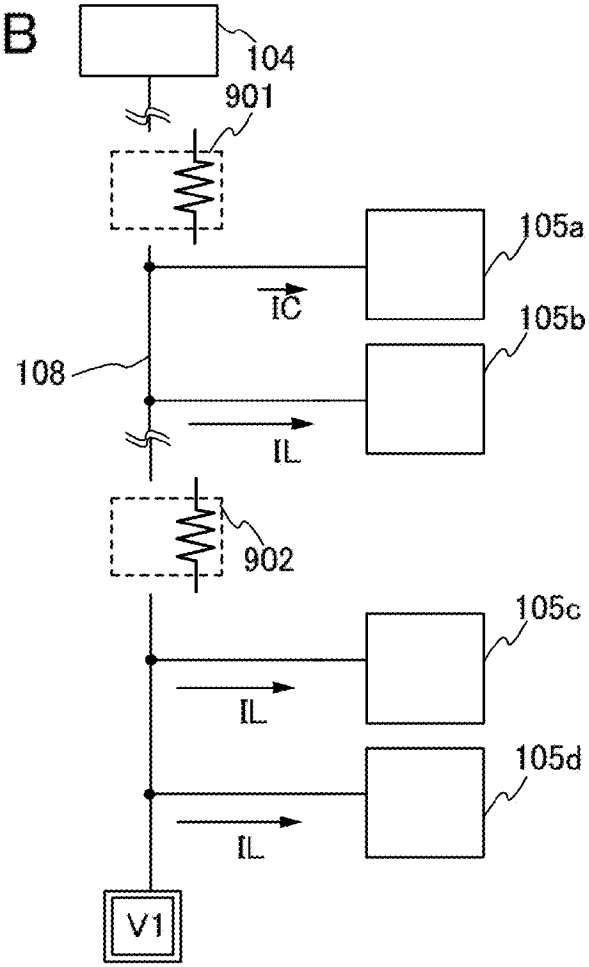
FIGS. 9A and 9B illustrate Embodiment 1.
Figure 9A:
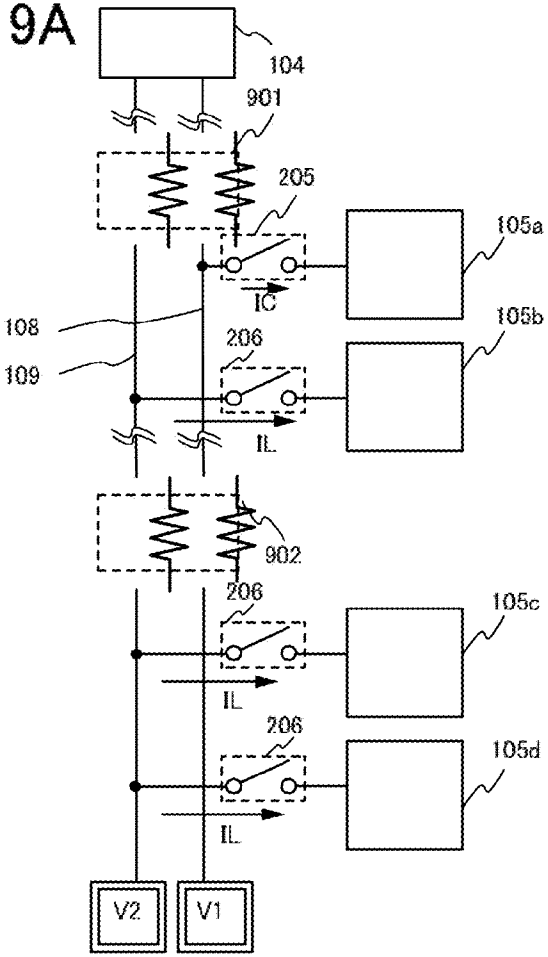

The difference between FIGS. 7A and 7B and FIGS. 8A and 8B will be described with reference to FIGS. 9A and 9B, and advantageous effect of the structure shown in this embodiment is described in detail. FIG. 9A illustrates a plurality of pixels 105*a* to 105*d* which are connected through the switches 205 and 206 to the wirings 108 and 109 extended from the power supply circuit 104. Parasitic resistance 901 and parasitic resistance 902 are shown on the wirings 108 and 109. The first potential and the second potential are supplied to the wirings 108 and 109 respectively, as in the description of FIGS. 7A and 7B. As in the above description, the switch 205 is on in the voltage program period, and the switch 206 is on in the light-emitting period. Moreover, FIG. 9B illustrates a plurality of pixels 105*a* to 105*d* connected to the wiring 108 extended from the power supply circuit 104. The parasitic resistance 901 and the parasitic resistance 902 are shown on the wiring 108. The first potential is supplied to the wiring 108 as in the description of FIGS. 8A and 8B. Note that description is made using FIGS. 9A and 9B on the assumption that when the pixels are scanned from the pixel 105*a* to the pixel 105*d*, the pixel 105*a* is in the voltage program period and the pixels 105*b* to 105*d* are in the light-emitting period.

In the configuration of the pixel circuit in the display device having the structure shown in this embodiment, the wirings for supplying current to the pixel can be switched between the voltage program period and the light-emitting period by using the switches 205 and 206 as illustrated in FIGS. 7A and 7B. This is different from the operation illustrated in FIGS. 8A and 8B. Accordingly, the pixel can enter into the light-emitting period without being affected by voltage drop, and the operation in the voltage program period can be performed without causing voltage drop.

For example, in FIG. 9B, the voltage of the wiring 108 drops due to the parasitic resistance 901 and the parasitic resistance 902 when current $I_L$ flowing to the pixels 105*b* to 105*d* connected to the wiring 108 is large, that is, when the luminance of light-emitting elements in the pixels 105*b* to 105*d* is high. Accordingly, regardless of the amount of current Ic flowing to the pixel 105*a* in the voltage program period, the voltage of the wiring 108 drops, that is, the first potential $V_1$ is reduced. Thus, in the pixel 105*a* connected to the wiring 108, Vgs of the transistor 203 cannot be maintained when the switch 201 is on. Note that current flowing through the wiring 108 for supplying current varies so that sometimes large current and sometimes almost no current flow through the wiring 108. That variation in current affects variation in voltage of the wiring for supplying current. The reason why the voltage of the wiring for supplying current varies is that the current $I_L$ for making the light-emitting element emit light is different depending on the gray level.

In FIG. 9A, the voltage of the wiring 109 drops due to the parasitic resistance 901 and the parasitic resistance 902 when the current $I_L$ flowing to the pixels 105*b* to 105*d* connected to the wiring 109 is large, that is, when the luminance of light-emitting elements in the pixels 105*b* to 105*d* is high. On the other hand, since the current Ic flowing to the pixel 105*a* in the voltage program period is smaller than the current $I_L$, the first potential $V_1$ is hardly reduced due to voltage drop.

The pixels per row in the display device are in either the voltage program period or the light-emitting period. Since gate lines sequentially enter the voltage program period in which video voltage is input to each pixel, the flowing current (the current Ic in FIGS. 9A and 9B) is extremely small. On the other hand, in the light-emitting period, the flowing current is different depending on the amount of current flowing to the pixel through a signal line (the current $I_L$ in FIGS. 9A and 9B), that is, the level of luminance of the light-emitting element included in the pixel; and when the current flows to the wiring, voltage drop occurs due to parasitic capacitance. Accordingly, in the structure illustrated in FIG. 9A, in which wirings connected to the pixel are switched between the voltage program period and the light-emitting period, connection is switched to the wiring 108 in the voltage program period so that adverse effect of voltage drop due to parasitic resistance is reduced, whereby adverse effect on the operation for compensating the threshold voltage in the pixel can be reduced. On the other hand, although the amount of current flowing through the wiring 109, to which the pixel is connected in the light-emitting period, is different depending on the amount of current flowing to the pixel, that is, the level of luminance of the light-emitting element included in the pixel, Vgs can be maintained by capacitive coupling; thus, adverse effect of voltage drop can be reduced.

With the structure shown in this embodiment, in the case where voltage drop due to parasitic resistance is large, adverse affect of malfunctions at the time when different potentials of the potential $V_1$ of the wiring 108 and the potential $V_2$ of the wiring 109 are supplied to each circuit can be reduced. Note that the first potential $V_1$ and the second potential $V_2$ are preferably output as equivalent potentials when outputting from the power supply circuit.

Next, a way of leading the wirings 108 and 109 in the display device will be described with reference to FIGS. 10A to 10D.

By switching connection of the wiring 108 and the wiring 109 per the kind of period, the threshold voltage can be compensated. As described above, in the voltage program period, the amount of current flowing through the wiring 108 is reduced as much as possible, whereby adverse effect of voltage drop is reduced. In the light-emitting period, the amount of current flowing through the wiring 109 is likely to be adversely affected by parasitic resistance because it is changed depending on the luminance of the light-emitting element; however, adverse effect of voltage drop is reduced by capacitive coupling.

Figure 10A:
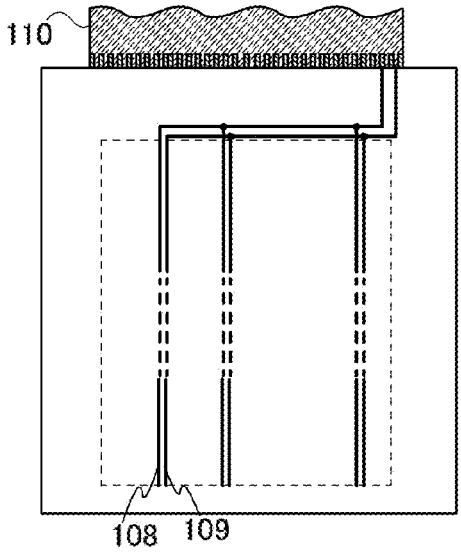
FIGS. 10A to 10D each illustrate Embodiment 1.
Figure 10B:
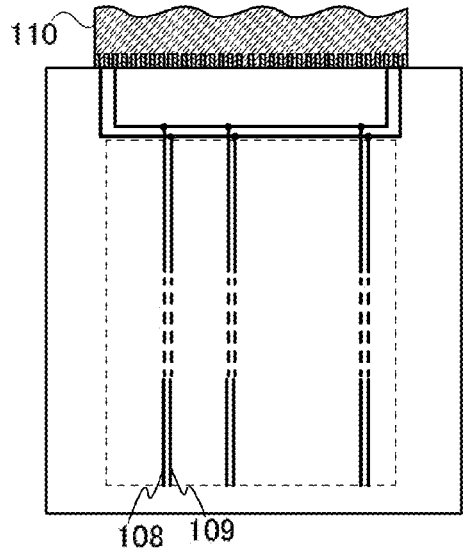
Figure 10C:
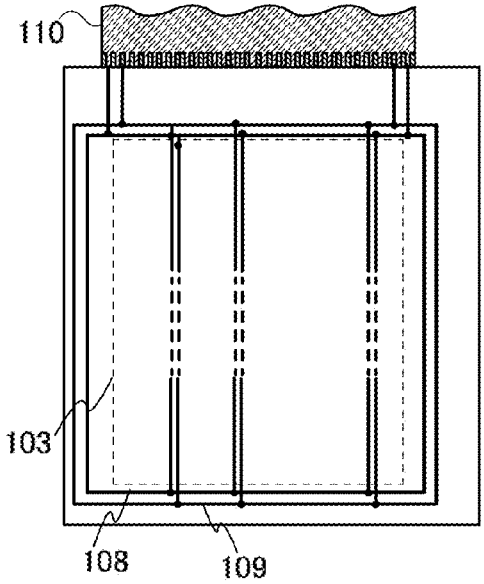
Figure 10D:
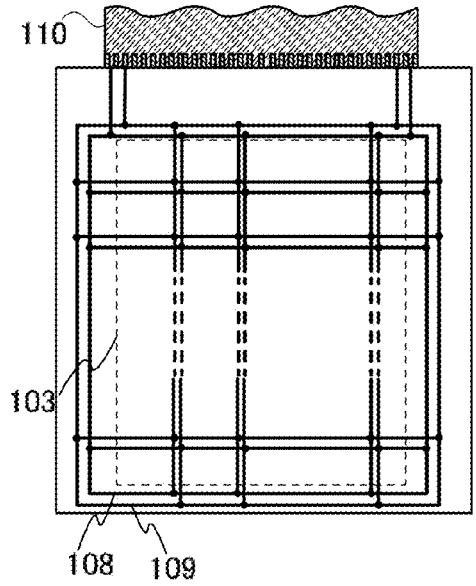

The wirings 108 and 109 led from the flexible printed circuit 110 may be led from one terminal of the flexible printed circuit 110 as illustrated in FIG. 10A. Alternatively, wirings serving as the wirings 108 and 109 may be led from a plurality of terminals of the flexible printed circuit 110 as illustrated in FIG. 10B. With the structure where the wirings 108 and 109 are led from a plurality of terminals, stable potentials can be supplied to each pixel. As illustrated in FIG. 10C, the wirings 108 and 109 may be arranged so as to surround the periphery of the display portion 103. In FIG. 10C, when the wiring 108 is provided on the inner side than the wiring 109, the length of the wiring led can be reduced; thus, adverse effect of voltage drop can be reduced. Further, it is preferable to employ a structure illustrated in FIG. 10D, in which the wirings 108 and 109 are provided so as to surround the display portion 103 and arranged in a grid pattern in a pixel portion, because stable potentials can be supplied to the wirings 108 and 109.

A power supply circuit may be provided in the path of the wirings 108 and 109 illustrated in FIGS. 10A to 10D.

As for the width of the wirings 108 and 109, the width of the wiring provided at the periphery of the display portion 103 may be made larger. When the width of the wiring provided around the display portion 103 is made larger than that of the wiring provided nearer to the display portion 103, the difference due to parasitic resistance of the wirings 108 and 109 because of increase in length of the wirings 108 and 109 led can be equalized. It is preferable that the wiring 108 connected to the pixel in the voltage program period be less likely to be affected by variation in potential due to parasitic resistance than the wiring 109 connected to the pixel in the light-emitting period. Accordingly, it is preferable to arrange the wiring 108 nearer to the display portion 103 so that the length of the wiring led is smaller and parasitic resistance is smaller.

Further, the width of the wiring 108 may be larger than that of the wiring 109. By making the width of the wiring 108 larger, parasitic resistance of the wiring 108 can be reduced. It is preferable that the wiring 108 connected to the pixel in the voltage program period be less likely to be affected by variation in potential due to parasitic resistance than the wiring 109 connected to the pixel in the light-emitting period.

The width of the wiring 108 and the width of the wiring 109 may vary by color element. It is preferable that the width of the wiring 108 and the width of the wiring 109 vary by color element because variation in luminance of color elements can be reduced.

Note that this embodiment is described with reference to a variety of drawings, and what is described (or part thereof) with reference to one drawing can be freely applied to, combined with, or exchanged with what is described (or part thereof) in another drawing or a drawing in another embodiment. Further, in the above-mentioned drawings, each portion can be combined with another portion and a portion in another embodiment.

Embodiment 2

In this embodiment, a structure of a display panel having a display portion including a variety of pixel circuits described in Embodiment 1 will be described.

Note that in this embodiment, a display panel includes a substrate where a pixel circuit is formed and the whole structure which is formed in contact with the substrate. For example, when a pixel circuit is formed over a glass substrate, a glass substrate, a transistor formed in contact with the glass substrate, a wiring, and the like are collectively referred to as a display panel.

A display panel is sometimes provided with a peripheral driver circuit for driving a pixel circuit in addition to a pixel circuit (integrated formation). A peripheral driver circuit typically includes, in its category, a scan driver for controlling a scan line of a display portion (also referred to as a scan line driver, a gate driver, or the like) and a data driver for controlling a signal line (also referred to as a signal line driver, a source driver, or the like), and further, includes a timing controller for controlling these drivers, a data processing unit for processing image data, a power supply circuit for generating power supply voltage, a reference voltage generating portion of a digital analog converter, or the like in some cases.

A peripheral driver circuit is formed over a substrate where a pixel circuit is formed in an integrated manner, so that the number of connection points of the substrate between a display panel and an external circuit can be reduced. Mechanical strength of the connection point of the substrate is weak, and poor connection easily occurs. Accordingly, by reducing the number of connection points of the substrate, the reliability of a device can be significantly improved. Moreover, the number of external circuits can be reduced; accordingly, manufacturing costs can be reduced.

However, a semiconductor element over the substrate where a pixel circuit is formed has low mobility and large variations in characteristics among elements as compared to an element formed on a single crystal semiconductor substrate. Accordingly, when a peripheral driver circuit and a pixel circuit are formed over the same substrate in an integrated manner, it is necessary to consider various factors such as increase in performance of an element which is necessary for realizing the function of the circuit, and a technique for the circuit which compensates the performance of an element.

When a peripheral driver circuit and a pixel circuit are formed over the same substrate in an integrated manner, the following structures can be mainly given, for example: (1) formation of only a display portion; (2) formation of a display portion and a scan driver in an integrated manner; (3) formation of a display portion, a scan driver, and a data driver in an integrated manner; and (4) formation of a display portion, a scan driver, a data driver, and other peripheral driver circuits in an integrated manner. Note that other combinations may also be used for the combination of circuits formed in an integrated manner. For example, when the frame area where scan driver is positioned has to be reduced while the frame area where data driver is positioned is not needed to be reduced, a structure of (5) formation of a display portion and a data driver in an integrated manner is most suitable in some cases. Similarly, the following structures can also be used: (6) formation of a display portion and other peripheral driver circuits in an integrated manner; (7) formation of a display portion, a data driver, and other peripheral driver circuits in an integrated manner; and (8) formation of a display portion, a scan driver, and other peripheral driver circuits in an integrated manner.

<(1) Formation of Only Display Portion>

Out of the above combinations, (1) formation of only a display portion is described with reference to FIG. 11A. A display panel 800 illustrated in FIG. 11A includes a display portion 801 and a connection point 802. The connection point 802 includes a plurality of electrodes, and a drive signal can be input from the outside of the display panel 800 to the inside of the display panel 800 by connecting a connection substrate 803 to the connection point 802.

Note that when a scan driver and a data driver are not formed in an integrated manner with a display portion, the number of electrodes included in the connection point 802 is approximately the same number as the sum of the number of scan lines and signal lines which are included in the display portion 801. Input of signals to signal lines may be performed by time division, so that the number of electrodes of the signal lines can be equal to one divided by the number of time divisions. For example, in the display device which can display colors, input to signal lines corresponding to R, G, and B is divided by time, so that the number of electrodes of the signal lines can be reduced to one-third. This is similar to other examples in this embodiment.

Note that as a peripheral driver circuit which is not formed in an integrated manner with the display portion 801, an IC manufactured with a single crystal semiconductor can be used. The IC may be mounted on an external printed wiring board, may be mounted on the connection substrate 803 (by TAB), or may be mounted on the display panel 800 (by COG). This is similar to other examples in this embodiment.

Note that in order to suppress a phenomenon (ESD; electrostatic discharge) that an element is damaged by static electricity caused in a scan line or a signal line included in the display portion 801, the display panel 800 may include an electrostatic discharge protection circuit between scan lines, signal lines, or power supply lines. Thus, the yield of the display panel 800 can be improved, whereby manufacturing costs can be reduced. This is similar to other examples in this embodiment.

Figure 11A:
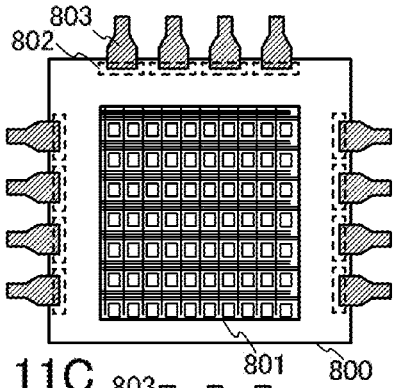
FIGS. 11A to 11H each illustrate an example of manufacturing a peripheral driver circuit.

The display panel 800 illustrated in FIG. 11A is effective particularly when a semiconductor element included in the display panel 800 is formed using a semiconductor having low mobility, such as amorphous silicon. This is because when peripheral driver circuits other than the display portion are not formed in an integrated manner with the display panel 800, the yield of the display panel 800 can be improved, so that manufacturing costs can be reduced.

<(2) Formation of Display Portion and Scan Driver in Integrated Manner>

Out of the above combinations, (2) formation of a display portion and a scan driver in an integrated manner is described with reference to FIG. 11B. The display panel 800 illustrated in FIG. 11B includes the display portion 801, the connection point 802, a scan driver 811, a scan driver 812, a scan driver 813, and a scan driver 814. The connection point 802 includes a plurality of electrodes, and a drive signal can be input from the outside of the display panel 800 to the inside of the display panel 800 by connecting the connection substrate 803 to the connection point 802.

Figure 11B:
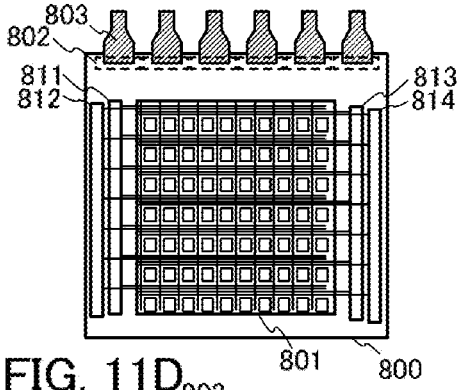

In the case of the display panel 800 in FIG. 11B, the scan drivers 811 to 814 are formed in an integrated manner with the display portion 801, so that the connection point 802 and the connection substrate 803 on the scan driver side are not needed. Accordingly, there is an advantage that an external substrate can be arranged more freely. Moreover, since the number of connection points of the substrate is small, poor connection is less likely to occur, and the reliability of a device can be improved.

A semiconductor element included in the display panel 800 illustrated in FIG. 11B may be formed using a semiconductor with low mobility, such as amorphous silicon, or may be formed using a semiconductor with high mobility, such as polysilicon or single crystal silicon. When the semiconductor element is formed using amorphous silicon, manufacturing costs can be reduced because the number of steps in a manufacturing process of an inverted staggered transistor is particularly small. When the semiconductor element is formed using polysilicon, the size of a transistor can be reduced due to high mobility; thus, the aperture ratio can be increased, and power consumption can be reduced. Further, since reduction in size of the transistor can reduce the area of the scan driver, the frame area can be reduced. When the semiconductor element is formed using single crystal silicon, the size of a transistor can be greatly reduced due to extremely high mobility. Accordingly, the aperture ratio can be further increased, and the frame area can be further reduced.

<(3) Formation of Display Portion, Scan Driver, and Data Driver in Integrated Manner>

Out of the above combinations, (3) formation of a display portion, a scan driver, and a data driver in an integrated manner is described with reference to FIG. 11C. The display panel 800 illustrated in FIG. 11C includes the display portion 801, the connection point 802, the scan driver 811, 812, 813, and 814, and a data driver 821. The connection point 802 includes a plurality of electrodes, and a drive signal can be input from the outside of the display panel 800 to the inside of the display panel 800 by connecting the connection substrate 803 to the connection point 802.

Figure 11C:
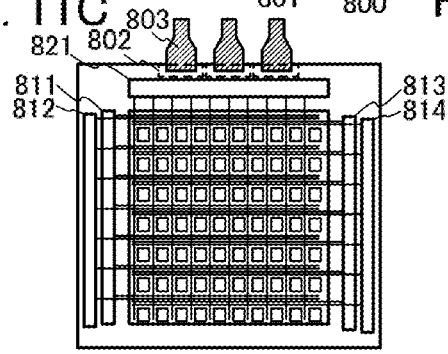

In the case of the display panel 800 illustrated in FIG. 11C, the scan drivers 811 to 814 and the data driver 821 are formed in an integrated manner with the display portion 801, so that the connection point 802 and the connection substrate 803 on the scan driver side are not needed, and further, the number of connection substrates 803 provided on the scan driver side can be reduced. Accordingly, there is an advantage that an external substrate can be arranged more freely. Moreover, since the number of connection points of the substrate is small, poor connection is less likely to occur, and the reliability of a device can be improved.

A semiconductor element included in the display panel 800 in FIG. 11C may be formed using a semiconductor with low mobility, such as amorphous silicon, or may be formed using a semiconductor with high mobility, such as polysilicon or single crystal silicon. When the semiconductor element is formed using amorphous silicon, manufacturing costs can be reduced because the number of steps in a manufacturing process of an inverted staggered transistor is particularly small. When the semiconductor element is formed using polysilicon, the size of a transistor can be reduced due to high mobility; thus, the aperture ratio can be increased, and power consumption can be reduced. Further, since reduction in size of the transistor can reduce the area of the scan driver and the data driver, the frame area can be reduced. Since the data driver particularly has higher drive frequency than the scan driver, a data driver which can be surely operated is realized by forming the semiconductor element using polysilicon.

When the semiconductor element is formed using single crystal silicon, the size of a transistor can be greatly reduced due to extremely high mobility. Accordingly, the aperture ratio can be further increased, and the frame area can be further reduced.

<(4) Formation of Display Portion, Scan Driver, Data Driver, and Other Peripheral Driver Circuits in Integrated Manner>

Out of the above combinations, (4) formation of a display portion, a scan driver, a data driver, and other peripheral driver circuits in an integrated manner is described with reference to FIG. 11D. The display panel 800 illustrated in FIG. 11D includes the display portion 801, the connection point 802, the scan drivers 811, 812, 813, and 814, the data driver 821, and other peripheral driver circuits 831, 832, 833, and 834. Here, it is an example that the number of other peripheral driver circuits formed in an integrated manner is four. Various number and kinds of the other peripheral driver circuits formed in an integrated manner can be employed. For example, the peripheral driver circuits 831 can be a timing controller. The peripheral driver circuit 832 can be a data processing unit for processing image data. The peripheral driver circuit 833 can be a power supply circuit for generating power supply voltage. The peripheral driver circuit 834 can be a reference voltage generating portion of a digital analog converter (DAC). The connection point 802 includes a plurality of electrodes, and a drive signal can be input from the outside of the display panel 800 to the inside of the display panel 800 by connecting the connection substrate 803 to the connection point 802.

Figure 11D:
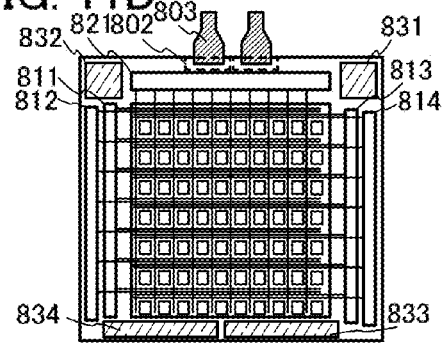

In the case of the display panel 800 illustrated in FIG. 11D, the scan drivers 811, 812, 813 and 814, the data driver 821, and the other peripheral driver circuits 831, 832, 833, and 834 are formed in an integrated manner with the display portion 801, so that the connection point 802 and the connection substrate 803 on the scan driver side are not needed, and further, the number of connection substrates 803 on the scan driver side can be reduced. Accordingly, there is an advantage that an external substrate can be arranged more freely. Moreover, since the number of connection points of the substrate is a small, poor connection is less likely to occur, and the reliability of a device can be improved.

A semiconductor element included in the display panel 800 in FIG. 11D may be formed using a semiconductor with low mobility, such as amorphous silicon, or may be formed using a semiconductor with high mobility, such as polysilicon or single crystal silicon. When the semiconductor element is formed using amorphous silicon, manufacturing costs can be reduced because the number of steps in a manufacturing process of an inverted staggered transistor is particularly small. When the semiconductor element is formed using polysilicon, the size of a transistor can be reduced due to high mobility; thus, the aperture ratio can be increased, and power consumption can be reduced. Further, since reduction in size of the transistor can reduce the area of the scan driver and the data driver, the frame area can be reduced. Since the data driver particularly has higher drive frequency than the scan driver, a data driver which can be surely operated is realized by forming the semiconductor element using polysilicon. Moreover, since a high-speed logic circuit (e.g., a data processing unit), or an analog circuit (e.g., a timing controller, a reference voltage generation portion of a DAC, or a power supply circuit) is needed for the other peripheral driver circuits, it is greatly advantageous to constitute a circuit by a semiconductor element having high mobility. Particularly when the semiconductor element is formed using single crystal silicon, the size of the transistor can be greatly reduced due to extremely high mobility. Thus, aperture ratio can be further increased, the frame area can be further reduced, and other peripheral driver circuits can be surely operated. Furthermore, the power supply voltage is set to be low, for example, whereby power consumption can be reduced.

<Formation with Other Combinations in Integrated Manner>

FIGS. 11E, 11F, 11G, and 11H illustrate (5) formation of a display portion and a data driver in an integrated manner, (6) formation of a display portion and other peripheral driver circuits in an integrated manner, (7) formation of a display portion, a data driver, and other peripheral driver circuits in an integrated manner, and (8) formation of a display portion, a scan driver, and other peripheral driver circuits in an integrated manner, respectively. Advantages of integrated formation and materials of the semiconductor elements are similar to those of the above description.

Figure 11E:
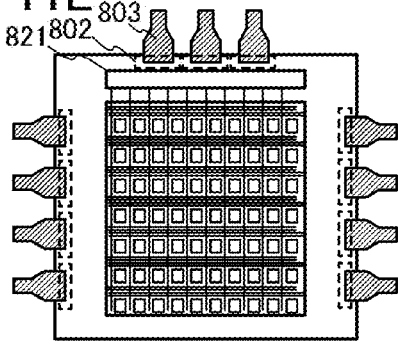

As illustrated in FIG. 11E, when the case of (5) formation of a display portion and a data driver in an integrated manner is realized, the frame area other than a portion where the data driver is provided can be reduced.

Figure 11F:
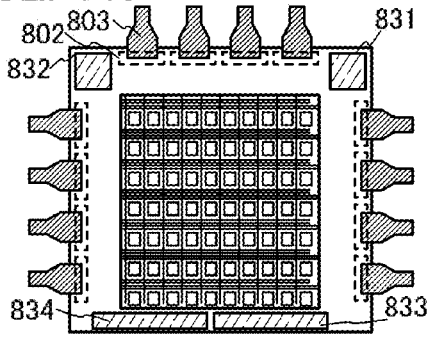

As illustrated in FIG. 11F, when the case of (6) formation of a display portion and other peripheral driver circuits in an integrated manner is realized, the other peripheral driver circuits can be freely arranged, so that the frame area can be reduced by selecting a portion which meets the purpose as appropriate.

Figure 11G:
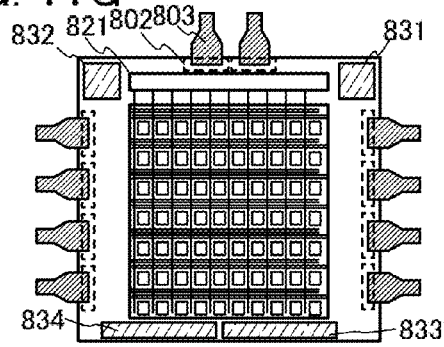

As illustrated in FIG. 11G, when the case of (7) formation of a display portion, a data driver, and other peripheral driver circuits in an integrated manner is realized, the frame area of a portion where the scan driver is provided can be reduced when the scan driver is formed in an integrated manner.

Figure 11H:
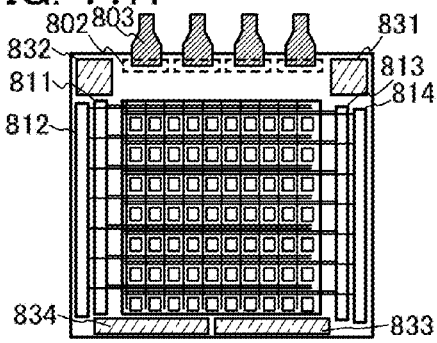

As illustrated in FIG. 11H, when the case of (8) formation of a display portion, a scan driver, and other peripheral driver circuits in an integrated manner is realized, the frame area of a portion where the data driver is provided can be reduced when the data driver is formed in an integrated manner.

Note that this embodiment is described with reference to a variety of drawings, and what is described (or part thereof) with reference to one drawing can be freely applied to, combined with, or exchanged with what is described (or part thereof) in another drawing or a drawing in another embodiment. Further, in the above-mentioned drawings, each portion can be combined with another portion and a portion in another embodiment.

Embodiment 3

In this embodiment, a structure and a manufacturing method of a transistor will be described.

Figure 12A:
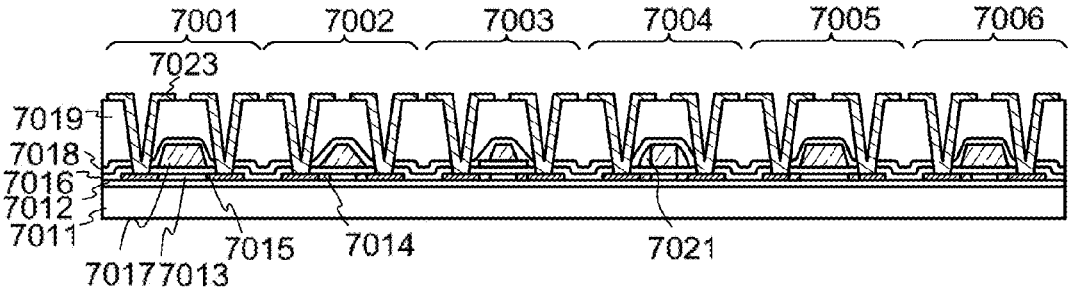
FIGS. 12A to 12G illustrate an example of manufacturing a semiconductor element.
Figure 12B:
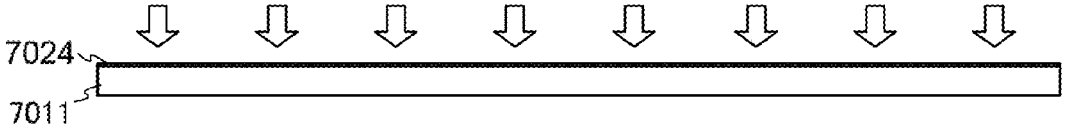
Figure 12C:
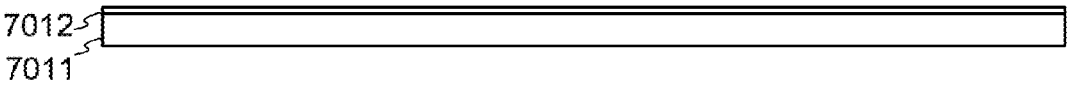
Figure 12D:
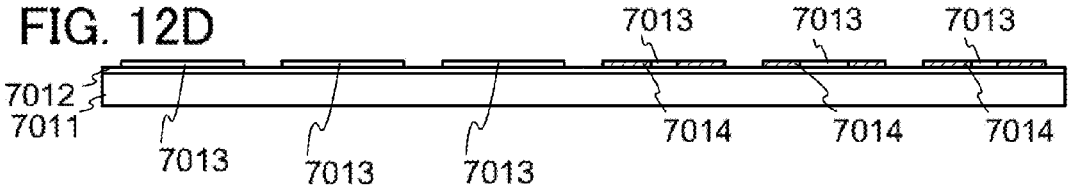
Figure 12E:
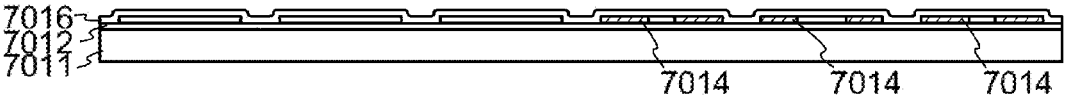
Figure 12F:
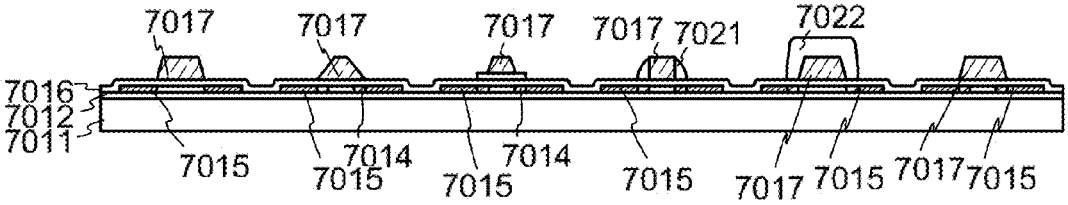
Figure 12G:
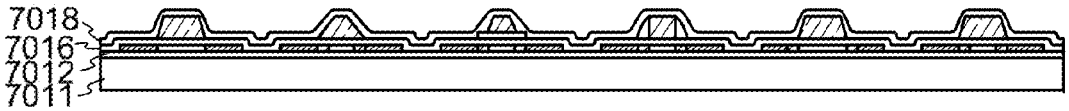

FIGS. 12A to 12G illustrate examples of structures and a manufacturing method of transistors. FIG. 12A illustrates examples of structures of transistors. FIGS. 12B to 12G illustrate an example of a method for manufacturing transistors.

Note that the structure and the manufacturing method of transistors are not limited to those illustrated in FIGS. 12A to 12G, and a variety of structures and manufacturing methods can be used.

First, structure examples of transistors are described with reference to FIG. 12A. FIG. 12A is a cross-sectional view of a plurality of transistors each having a different structure. Here, in FIG. 12A, the plurality of transistors each having different structures are placed in a line, which is for describing structures of the transistors. Accordingly, the transistors are not needed to be actually placed as illustrated in FIG. 12A and can be separately formed as needed.

Note that when it is explicitly described that B is formed on or over A, it does not necessarily mean that B is formed in direct contact with A. The description includes the case where A and B are not in direct contact with each other, that is, the case where another object is placed between A and B. Here, each of A and B is an object (e.g., a device, an element, a circuit, a wiring, an electrode, a terminal, a conductive film, or a layer).

Accordingly, for example, when it is explicitly described that a layer B is formed on (or over) a layer A, it includes both the case where the layer B is formed in direct contact with the layer A; and the case where another layer (e.g., a layer C or a layer D) is formed in direct contact with the layer A, and the layer B is formed in direct contact with the layer C or D. Note that another layer (e.g., the layer C or the layer D) may be a single layer or a plurality of layers.

Similarly, when it is explicitly described that B is formed above A, it does not necessarily mean that B is formed in direct contact with A, and another object may be placed between A and B. Accordingly, the case where a layer B is formed above a layer A includes the case where the layer B is formed in direct contact with the layer A and the case where another layer (e.g., a layer C and a layer D) is formed in direct contact with the layer A and the layer B is formed in direct contact with the layer C or D. Note that another layer (e.g., the layer C or the layer D) may be a single layer or a plurality of layers.

Note that when it is explicitly described that B is formed over, on, or above A, it includes the case where B is formed obliquely over/above A.

Note that the same can be said when it is explicitly described that B is formed below or under A.

Next, characteristics of layers included in a transistor are described.

A substrate 7011 can be a glass substrate such as barium borosilicate glass or aluminoborosilicate glass, a quartz substrate, a ceramic substrate or a metal substrate containing stainless steel, for example. Moreover, it is possible to use a substrate formed of plastic typified by polyethylene terephthalate (PET), polyethylene naphthalate (PEN), or polyethersulfone (PES), or a flexible synthetic resin such as acrylic. By using a flexible substrate, a display device which can be bent can be formed. A flexible substrate has no restrictions on the area and shape of a substrate to be used; thus, when a rectangular substrate with a side of one meter or more is used as the substrate 7011, for example, the productivity can be significantly improved. This is a great advantage over the case of using a circular silicon substrate.

An insulating film 7012 serves as a base film. The insulating film 7012 is provided in order to prevent alkali metal such as Na or alkaline earth metal from the substrate 7011 from adversely affecting characteristics of a semiconductor element. The insulating film 7012 can have a single-layer structure or a layered structure of an insulating film containing oxygen or nitrogen, such as silicon oxide ($SiO_x$), silicon nitride ($SiN_x$), silicon oxynitride ($SiO_xN_y$, x>y), or silicon nitride oxide ($SiN_xO_y$, x>y). For example, when the insulating film 7012 has a two-layer structure, it is preferable that a silicon nitride oxide film be used as a first insulating film and a silicon oxynitride film be used as a second insulating film. When the insulating film 7012 has a three-layer structure, it is preferable that a silicon oxynitride film be used as a first insulating film, a silicon nitride oxide film be used as a second insulating film, and a silicon oxynitride film be used as a third insulating film.

Semiconductor layers 7013, 7014, and 7015 can be formed using an amorphous semiconductor, a microcrystalline semiconductor, an oxide semiconductor, or a semi-amorphous semiconductor (SAS). Alternatively, a polycrystalline semiconductor layer may be used. SAS is a semiconductor having an intermediate structure between amorphous and crystalline (including single crystal and polycrystalline) structures and having a third state which is stable in free energy, and includes a crystalline region having short-range order and lattice distortion. At least part of a region in a film includes a crystalline region of 0.5 nm to 20 nm. When silicon is contained as a main component, Raman spectrum shifts to a wave number side lower than 520 $cm^{-1}$. The diffraction peaks of (111) and (220) which are thought to be derived from a silicon crystalline lattice are observed by X-ray diffraction. SAS contains hydrogen or halogen of at least 1 atomic % or more to terminate dangling bonds. SAS is formed by glow discharge decomposition (plasma CVD) of a source gas. As the source gas, $SiH_4$, $Si_2H_6$, $SiH_2Cl_2$, $SiHCl_3$, $SiCl_4$, $SiF_4$, or the like can be used. Further, GeF4 may be mixed. Alternatively, the source gas may be diluted with $H_2$, or $H_2$ and one or more of rare gas elements selected from He, Ar, Kr, and Ne. A dilution ratio is in the range of 2 to 1000 times. The pressure is in the range of approximately 0.1 Pa to 133 Pa, and the power supply frequency is 1 MHz to 120 MHz, preferably 13 MHz to 60 MHz. The substrate heating temperature may be 300° C. or lower. The concentration of impurities of atmospheric components such as oxygen, nitrogen, and carbon as impurity elements in the film is preferably $1\times10^{20}/cm^3$ or less; particularly, the oxygen concentration is $5\times10^{19}/cm^3$ or less, preferably $1\times10^{19}/cm^3$ or less. Here, an amorphous semiconductor layer is formed using a material containing silicon (Si) as its main component (e.g., $Si_xGe_{1-x}$) by a sputtering method, an LPCVD method, a plasma CVD method, or the like. Then, the amorphous semiconductor layer is crystallized by a crystallization method such as a laser crystallization method, a thermal crystallization method using RTA or an annealing furnace, or a thermal crystallization method using a metal element which promotes crystallization.

Note that an oxide semiconductor is represented by $InMO_3(ZnO)_m$ (m>0). Note that M represents one or more of metal elements selected from gallium (Ga), iron (Fe), nickel (Ni), manganese (Mn), or cobalt (Co). As an example, M may be Ga or may include the above metal element in addition to Ga, for example, M may be Ga and Ni or Ga and Fe. Moreover, the oxide semiconductor may contain a transition metal element such as Fe or Ni or oxide of the transition metal element as an impurity element in addition to the metal element contained as M. Note that in this specification, a thin film formed using this oxide semiconductor is also referred to as an In—Ga—Zn—O-based non-single-crystal film.

The amorphous structure can be observed as the crystal structure of the In—Ga—Zn—O-based non-single-crystal film by X-ray diffraction (XRD) analysis after the film is formed by a sputtering method and subjected to heat treatment at a temperature of 200° C. to 500° C., specifically 300° C. to 400° C. for 10 to 100 minutes. Moreover, as for electric characteristics, a TFT with an on/off ratio of $10^9$ or more and a mobility of 10 or more in the case where the gate voltage is ±20 V can be manufactured. A thin film transistor formed using an oxide semiconductor film with such electric characteristics has a higher mobility than a thin film transistor formed using amorphous silicon, so that a circuit including the thin film transistor using the oxide semiconductor film can be driven at high speed.

Note that the oxide semiconductor can be formed in such a manner that an oxide semiconductor layer is formed over a gate insulating film by a sputtering method, and then, a resist mask is formed over the oxide semiconductor layer by a photolithography process or an inkjet method, and the oxide semiconductor layer is etched using the resist mask. As a target used for the sputtering method for forming the oxide semiconductor layer, a target in which the composition ratio is $In_2O_3$:$Ga_2O_3$:ZnO=1:1:1 (In:Ga:Zn=1:1:0.5) is used. The oxide semiconductor has a light-transmitting property favorable to light used for light exposure of a photo resist, which is performed later; thus, the photo resist can be exposed to light more effectively as compared to the case of using amorphous silicon.

An insulating film 7016 can have a single-layer structure or a layered structure of an insulating film containing oxygen or nitrogen, such as silicon oxide ($SiO_x$), silicon nitride ($SiN_x$), silicon oxynitride ($SiO_xN_y$, x>y), or silicon nitride oxide ($SiN_xO_y$, x>y).

A gate electrode 7017 can have a single-layer structure of a conductive film or a layered structure of two or three conductive films. As a material for the gate electrode 7017, a conductive film can be used. For example, a film of an element such as tantalum (Ta), titanium (Ti), molybdenum (Mo), tungsten (W), chromium (Cr), or silicon (Si); a nitride film containing the element (typically, a tantalum nitride film, a tungsten nitride film, or a titanium nitride film); an alloy film in which the elements are combined (typically, a Mo—W alloy or a Mo—Ta alloy); a silicide film containing the element (typically, a tungsten silicide film or a titanium silicide film); and the like can be used. Note that the above-described film of such an element, nitride film, alloy film, silicide film, and the like can have a single-layer structure or a layered structure.

An insulating film 7018 can have a single-layer structure or a layered structure of an insulating film containing oxygen or nitrogen, such as silicon oxide ($SiO_x$), silicon nitride ($SiN_x$), silicon oxynitride ($SiO_xN_y$, x>y), or silicon nitride oxide ($SiN_xO_y$, x>y); or a film containing carbon, such as a DLC (diamond-like carbon), by a sputtering method, a plasma CVD method, or the like.

An insulating film 7019 can have a single-layer structure or a layered structure of a siloxane resin; an insulating film containing oxygen or nitrogen, such as silicon oxide ($SiO_x$), silicon nitride ($SiN_x$), silicon oxynitride ($SiO_xN_y$, x>y), or silicon nitride oxide ($SiN_xO_y$, x>y); a film containing carbon, such as a DLC (diamond-like carbon); or an organic material such as epoxy, polyimide, polyamide, polyvinyl phenol, benzocyclobutene, or acrylic. Note that a siloxane resin corresponds to a resin having Si—O—Si bonds. Siloxane has a skeleton structure of a bond of silicon (Si) and oxygen (O). As a substituent, an organic group (e.g., an alkyl group or aromatic hydrocarbon) or a fluoro group may be used. A fluoro group may be included in the organic group. Note that the insulating film 7019 can be provided to cover the gate electrode 7017 directly without provision of the insulating film 7018.

As a conductive film 7023, a film of an element such as Al, Ni, C, W, Mo, Ti, Pt, Cu, Ta, Au, or Mn, a nitride film containing the element, an alloy film in which the elements are combined, a silicide film containing the element, or the like can be used. For example, as an alloy containing a plurality of the above elements, an Al alloy containing C and Ti, an Al alloy containing Ni, an Al alloy containing C and Ni, an Al alloy containing C and Mn, or the like can be used. For example, when the conductive film 7023 is provided to have a layered structure, a structure in which Al is provided between Mo or Ti can be employed. Accordingly, the resistance of Al to heat or chemical reaction can be improved.

Next, characteristics of structures of the transistors are described with reference to the cross-sectional view of a plurality of transistors each having a different structure in FIG. 12A.

A transistor 7001 is a single drain transistor. Since the transistor 7001 can be formed by a simple method, it is advantageous in low manufacturing cost and high yield. Note the taper angle is equal to or larger than 45° and smaller than 95°, preferably equal to or larger than 60° and smaller than 95°. Alternatively, the taper angle may be smaller than 45°. Here, the semiconductor layers 7013 and 7015 have different impurity concentration from each other, and the semiconductor layer 7013 is used as a channel region and the semiconductor layers 7015 are used as a source region and a drain region. By controlling the amount of impurities in such a manner, the resistivity of the semiconductor layers can be controlled. Further, an electrical connection state between the semiconductor layer and the conductive film 7023 can be closer to ohmic contact. As a method of forming the semiconductor layers each having different amount of impurities, a method where impurities are added to the semiconductor layers using the gate electrode 7017 as a mask can be used.

A transistor 7002 is a transistor whose gate electrode 7017 has a tapered angle of at least certain degrees. Since the transistor 7002 can be formed by a simple method, it is advantageous in low manufacturing cost and high yield. Here, the semiconductor layers 7013, 7014, and 7015 have different impurity concentration from each other. The semiconductor layer 7013 is used as a channel region, the semiconductor layers 7014 as lightly doped drain (LDD) regions, and the semiconductor layers 7015 as a source region and a drain region. By controlling the amount of impurities in this manner, the resistivity of the semiconductor layers can be controlled. Further, an electrical connection state between the semiconductor layer and the conductive film 7023 can be closer to ohmic contact. Since the transistor includes the LDD regions, a high electric field is hardly applied inside the transistor, so that deterioration of the element due to hot carriers can be suppressed. As a method of forming the semiconductor layers each having different amount of impurities, a method where impurities are added to the semiconductor layers using the gate electrode 7017 as a mask can be used. In the transistor 7002, since the gate electrode 7017 has a tapered angle of at least certain degrees, the concentration gradient of impurities added to the semiconductor layer through the gate electrode 7017 can be provided, and the LDD region can be easily formed. Note the taper angle is equal to or larger than 45° and smaller than 95°, preferably equal to or larger than 60° and smaller than 95°. Alternatively, the taper angle may be smaller than 45°.

A transistor 7003 is a transistor in which the gate electrode 7017 includes at least two layers and a lower gate electrode is longer than an upper gate electrode. In this specification, the shape of the upper gate electrode and the lower gate electrode is referred to as a hat shape. When the gate electrode 7017 has a hat shape, an LDD region can be formed without addition of a photomask. Note that a structure where the LDD region overlaps with the gate electrode 7017, like the transistor 7003, is particularly called a GOLD (gate overlapped LDD) structure. As a method of forming the gate electrode 7017 with a hat shape, the following method may be used.

First, when the gate electrode 7017 is patterned, the lower and upper gate electrodes are etched by dry etching so that side surfaces thereof are inclined (tapered). Then, the inclination of the upper gate electrode is processed to be almost perpendicular by anisotropic etching. Thus, the gate electrode is formed such that the cross section is hat-shaped. After that, impurity elements are doped twice, so that the semiconductor layer 7013 used as the channel region, the semiconductor layers 7014 used as the LDD regions, and the semiconductor layers 7015 used as a source electrode and a drain electrode are formed.

Note that a portion of the LDD region, which overlaps with the gate electrode 7017, is referred to as an Lov region, and a portion of the LDD region, which does not overlap with the gate electrode 7017, is referred to as an Loff region. Here, the Loff region is highly effective in suppressing the off-state current, whereas it is not very effective in preventing deterioration in the on-state current due to hot carriers by relieving the electric field in the vicinity of the drain. On the other hand, the Lov region is highly effective in preventing deterioration in the on-state current by relieving the electric field in the vicinity of the drain; however, it is not very effective in suppressing the off-state current. Accordingly, it is preferable to form a transistor having a structure appropriate for characteristics of each of various circuits. For example, in a display device, a transistor having an Loff region is preferably used as a pixel transistor in order to suppress the off-state current. On the other hand, as a transistor in a peripheral circuit, a transistor having an Lov region is preferably used in order to prevent deterioration in on-state current by relieving the electric field in the vicinity of the drain.

A transistor 7004 is a transistor including a sidewall 7021 in contact with a side surface of the gate electrode 7017. When the transistor includes the sidewall 7021, a region overlapping with the sidewall 7021 can serve as an LDD region.

A transistor 7005 is a transistor in which an LDD (Loff) region is formed by adding an impurity element to the semiconductor layer by using a mask 7022. Accordingly, the LDD region can surely be formed, and the off-state current of the transistor can be reduced.

A transistor 7006 is a transistor in which an LDD (Lov) region is formed by adding an impurity element to the semiconductor layer by using a mask. Thus, the LDD region can surely be formed, and deterioration in on-state current can be prevented by relieving the electric field in the vicinity of the drain of the transistor.

Next, FIGS. 12B to 12G illustrate an example of a method for manufacturing a transistor.

Note that the structure and the manufacturing method of transistors are not limited to those illustrated in FIGS. 12A to 12G, and a variety of structures and manufacturing methods can be used.

In this embodiment, a surface of the substrate 7011, a surface of the insulating film 7012, a surface of the semiconductor layer 7013, a surface of the semiconductor layer 7014, a surface of the semiconductor layer 7015, a surface of the insulating film 7016, a surface of the insulating film 7018, and/or a surface of the insulating film 7019 is/are oxidized or nitrided by plasma treatment, so that the semiconductor layer or the insulating film can be oxidized or nitrided. By oxidizing or nitriding the semiconductor layer or the insulating film by plasma treatment in such a manner, the surface of the semiconductor layer or the insulating film is modified, and the insulating film can be formed to be denser than an insulating film formed by a CVD method or a sputtering method. Thus, defects such as a pinhole can be suppressed, and characteristics and the like of the display device can be improved. Note that an insulating film 7024 formed by the plasma treatment is referred to as a plasma-treated insulating film.

Silicon oxide ($SiO_x$) or silicon nitride ($SiN_x$) can be used for the sidewall 7021. As a method of forming the sidewall 7021 on the side surface of the gate electrode 7017, a method can be used, for example, in which after the gate electrode 7017 is formed, a film of silicon oxide ($SiO_x$) or silicon nitride ($SiN_x$) is formed, and then, the silicon oxide ($SiO_x$) film or the silicon nitride ($SiN_x$) film is etched by anisotropic etching. Thus, the silicon oxide ($SiO_x$) film or the silicon nitride ($SiN_x$) film remains only on the side surface of the gate electrode 7017, so that the sidewall 7021 can be formed on the side surface of the gate electrode 7017.

Figure 13A:
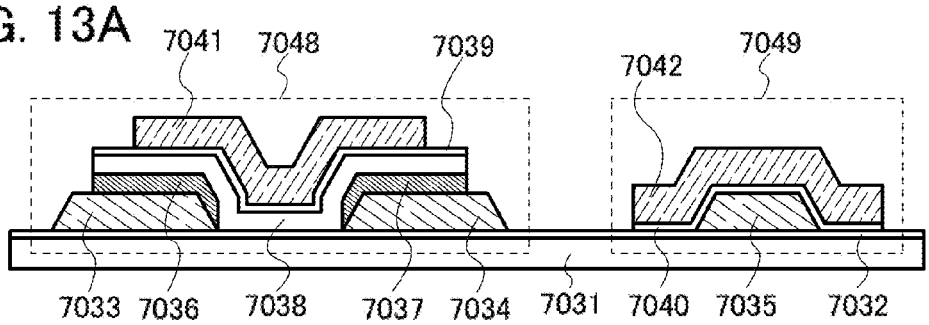
FIGS. 13A to 13D each illustrate an example of manufacturing a semiconductor element.
Figure 13B:
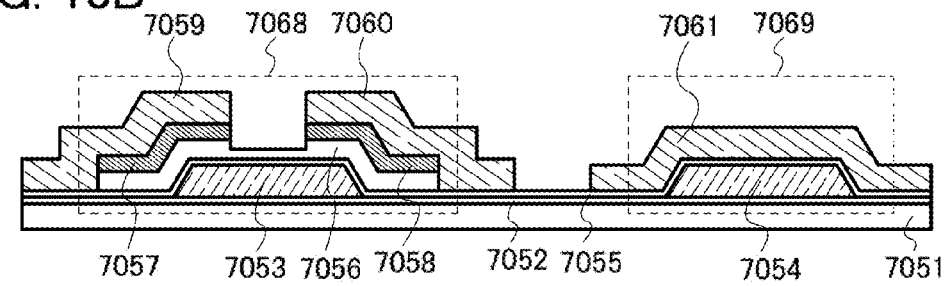
Figure 13C:
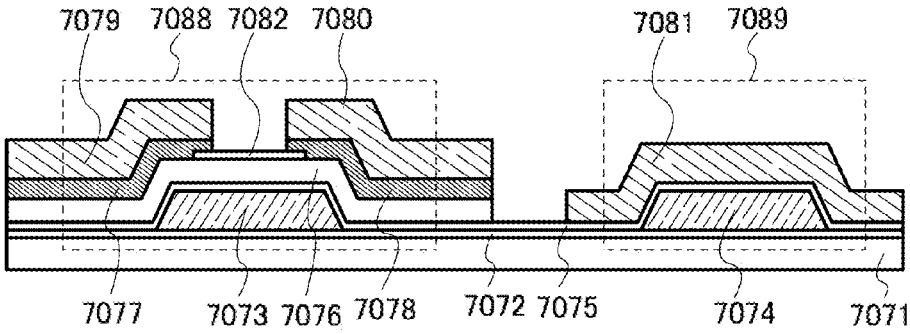
Figure 13D:
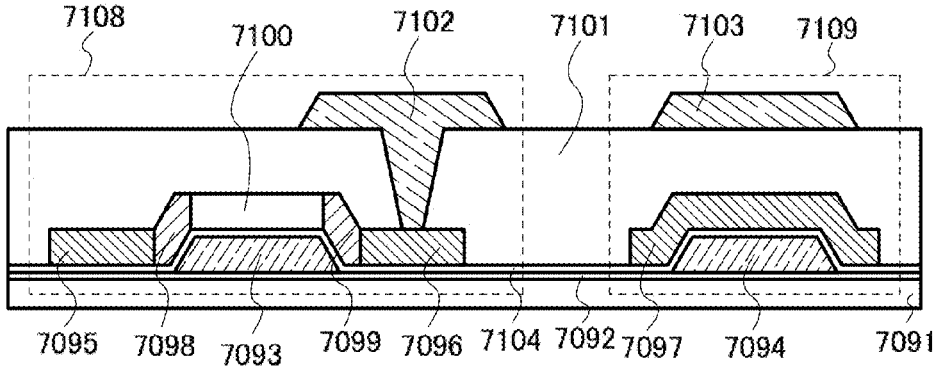

FIG. 13D illustrates cross-sectional structures of a bottom gate transistor and a capacitor.

A first insulating film (an insulating film 7092) is formed entirely over a substrate 7091. Note that this embodiment is not limited to this. The first insulating film (the insulating film 7092) is not necessarily formed in some cases. The first insulating film can prevent impurities from the substrate from adversely affecting a semiconductor layer and changing characteristics of the transistor. That is, the first insulating film functions as a base film. Accordingly, a highly reliable transistor can be manufactured. As the first insulating film, a single layer or a stack of a silicon oxide film, a silicon nitride film, or a silicon oxynitride film ($SiO_xN_y$) can be used.

A first conductive layer (a conductive layer 7093 and a conductive layer 7094) is formed over the first insulating film. The conductive layer 7093 includes a portion functioning as a gate electrode of a transistor 7108. The conductive layer 7094 includes a portion functioning as a first electrode of a capacitor 7109. As the first conductive layer, Ti, Mo, Ta, Cr, W, Al, Nd, Cu, Ag, Au, Pt, Nb, Si, Zn, Fe, Ba, or Ge, or an alloy of these elements can be used. Alternatively, a stack of any of these elements (including an alloy thereof) can be used.

A second insulating film (an insulating film 7104) is formed so as to cover at least the first conductive layer. The second insulating film functions as a gate insulating film. As the second insulating film, a single layer or a stack of a silicon oxide film, a silicon nitride film, or a silicon oxynitride film ($SiO_xN_y$) can be used.

As the second insulating film which is in contact with the semiconductor layer, a silicon oxide film is preferably used. This is because the trap level at the interface between the semiconductor layer and the second insulating film can be reduced.

When the second insulating film is in contact with Mo, a silicon oxide film is preferably used as a portion of the second insulating film in contact with Mo. This is because the silicon oxide film does not oxidize Mo.

A semiconductor layer is formed in part of a portion over the second insulating film, which overlaps with the first conductive layer, by a photolithography method, an inkjet method, a printing method, or the like. Part of the semiconductor layer extends to a portion over the second insulating film, which does not overlap with the first conductive layer. The semiconductor layer includes a channel formation region (a channel formation region 7100), an LDD region (LDD regions 7098 and 7099), and an impurity region (impurity regions 7095, 7096, and 7097). The channel formation region 7100 functions as a channel formation region of the transistor 7108. The LDD regions 7098 and 7099 function as LDD regions of the transistor 7108. Note that the LDD regions 7098 and 7099 are not necessarily formed. The impurity region 7095 includes a portion functioning as one of a source electrode and a drain electrode of the transistor 7108. The impurity region 7096 includes a portion functioning as the other of the source electrode and the drain electrode of the transistor 7108. The impurity region 7097 includes a portion functioning as a second electrode of the capacitor 7109.

A third insulating film (an insulating film 7101) is entirely formed. A contact hole is selectively formed in part of the third insulating film. The insulating film 7101 functions as an interlayer film. As the third insulating film, an inorganic material (e.g., silicon oxide, silicon nitride, or silicon oxynitride), an organic compound material having a low dielectric constant (e.g., a photosensitive or non-photosensitive organic resin material), or the like can be used. Alternatively, a material containing siloxane may be used. Note that siloxane is a material with a skeleton structure of a bond of silicon (Si) and oxygen (O). As a substituent, an organic group (e.g., an alkyl group or aromatic hydrocarbon) or a fluoro group may be used. A fluoro group may be included in the organic group.

A second conductive layer (a conductive layer 7102 and a conductive layer 7103) is formed over the third insulating film. The conductive layer 7102 is connected to the other of the source electrode and the drain electrode of the transistor 7108 through the contact hole formed in the third insulating film. Therefore, the conductive layer 7102 includes a portion functioning as the other of the source electrode and the drain electrode of the transistor 7108. When the conductive layer 7103 is connected to the conductive layer 7094, the conductive layer 7103 includes a portion functioning as the first electrode of the capacitor 7109. When the conductive layer 7103 is connected to the impurity region 7097, the conductive layer 7103 includes a portion functioning as the second electrode of the capacitor 7109. Alternatively, when the conductive layer 7103 is not connected to the conductive layer 7094 and the impurity region 7097, a capacitor other than the capacitor 7109 is formed. In this capacitor, the conductive layer 7103, the impurity region 7097, and the insulating film 7101 are used as a first electrode, a second electrode, and an insulating film, respectively. As the second conductive layer, Ti, Mo, Ta, Cr, W, Al, Nd, Cu, Ag, Au, Pt, Nb, Si, Zn, Fe, Ba, or Ge, or an alloy of these elements can be used. Further, a stack including any of these elements (including an alloy thereof) can be used.

Note that in steps after the second conductive layer is formed, a variety of insulating films or conductive films may be formed.

Next, structures of a transistor and a capacitor are described in the case where an amorphous silicon (a-Si:H) film, a microcrystalline silicon film, or the like is used as a semiconductor layer of the transistor.

FIG. 13A illustrates cross-sectional structures of a top-gate transistor and a capacitor.

A first insulating film (an insulating film 7032) is formed entirely over a substrate 7031. The first insulating film can prevent impurities from the substrate from adversely affecting a semiconductor layer and changing characteristics of the transistor. That is, the first insulating film functions as a base film. Accordingly, a highly reliable transistor can be manufactured. As the first insulating film, a single layer or a stack of a silicon oxide film, a silicon nitride film, or a silicon oxynitride film ($SiO_xN_y$) can be used.

Note that the first insulating film is not necessarily formed. If the first insulating film is not formed, the number of steps can be reduced, and manufacturing costs can be reduced. Since the structure can be simplified, the yield can be increased.

A first conductive layer (a conductive layer 7033, a conductive layer 7034, and a conductive layer 7035) is formed over the first insulating film. The conductive layer 7033 includes a portion functioning as one of a source electrode and a drain electrode of a transistor 7048. The conductive layer 7034 includes a portion functioning as the other of the source electrode and the drain electrode of the transistor 7048. The conductive layer 7035 includes a portion functioning as a first electrode of a capacitor 7049. As the first conductive layer, Ti, Mo, Ta, Cr, W, Al, Nd, Cu, Ag, Au, Pt, Nb, Si, Zn, Fe, Ba, or Ge, or an alloy of these elements can be used. Further, a stack including any of these elements (including an alloy thereof) can be used.

A first semiconductor layer (a semiconductor layer 7036 and a semiconductor layer 7037) is formed over the conductive layers 7033 and 7034. The semiconductor layer 7036 includes a portion functioning as one of the source electrode and the drain electrode. The semiconductor layer 7037 includes a portion functioning as the other of the source electrode and the drain electrode. As the first semiconductor layer, silicon containing phosphorus or the like can be used, for example.

A second semiconductor layer (a semiconductor layer 7038) is formed in a portion which is between the conductive layer 7033 and the conductive layer 7034 and over the first insulating film. Part of the semiconductor layer 7038 extends to a portion over the conductive layers 7033 and 7034. The semiconductor layer 7038 includes a portion functioning as a channel region of the transistor 7048. As the second semiconductor layer, a semiconductor layer with non-crystallinity, such as an amorphous silicon (a-Si:H) layer, or a semiconductor layer such as a microcrystalline silicon (μ-Si:H) layer can be used.

A second insulating film (an insulating film 7039 and an insulating film 7040) is formed so as to cover at least the semiconductor layer 7038 and the conductive layer 7035. The second insulating film functions as a gate insulating film. As the second insulating film, a single layer or a stack of a silicon oxide film, a silicon nitride film, or a silicon oxynitride film ($SiO_xN_y$) can be used.

As the second insulating film which is in contact with the second semiconductor layer, a silicon oxide film is preferably used. This is because the trap level at the interface between the second semiconductor layer and the second insulating film can be reduced.

When the second insulating film is in contact with Mo, a silicon oxide film is preferably used as a portion of the second insulating film in contact with Mo. This is because the silicon oxide film does not oxidize Mo.

A second conductive layer (a conductive layer 7041 and a conductive layer 7042) is formed over the second insulating film. The conductive layer 7041 includes a portion functioning as a gate electrode of the transistor 7048. The conductive layer 7042 serves as a second electrode of the capacitor 7049 or a wiring. As the second conductive layer, Ti, Mo, Ta, Cr, W, Al, Nd, Cu, Ag, Au, Pt, Nb, Si, Zn, Fe, Ba, or Ge, or an alloy of these elements can be used. Further, a stack including any of these elements (including an alloy thereof) can be used.

Note that in steps after the second conductive layer is formed, a variety of insulating films or conductive films may be formed.

FIG. 13B illustrates cross-sectional structures of an inverted staggered (bottom-gate) transistor and a capacitor. In particular, the transistor illustrated in FIG. 13B has a channel-etched structure.

A first insulating film (an insulating film 7052) is formed entirely over a substrate 7051. The first insulating film can prevent impurities from the substrate from adversely affecting a semiconductor layer and changing characteristics of the transistor. That is, the first insulating film functions as a base film. Accordingly, a highly reliable transistor can be manufactured. As the first insulating film, a single layer or a stack of a silicon oxide film, a silicon nitride film, or a silicon oxynitride film ($SiO_xN_y$) can be used.

Note that the first insulating film is not necessarily formed. If the first insulating film is not formed, the number of steps can be reduced, and manufacturing costs can be reduced. Since the structure can be simplified, the yield can be increased.

A first conductive layer (a conductive layer 7053 and a conductive layer 7054) is formed over the first insulating film. The conductive layer 7053 includes a portion functioning as a gate electrode of a transistor 7068. The conductive layer 7054 includes a portion functioning as a first electrode of a capacitor 7069. As the first conductive layer, Ti, Mo, Ta, Cr, W, Al, Nd, Cu, Ag, Au, Pt, Nb, Si, Zn, Fe, Ba, or Ge, or an alloy of these elements can be used. Further, a stack including any of these elements (including an alloy thereof) can be used.

A second insulating film (an insulating film 7055) is formed so as to cover at least the first conductive layer. The second insulating film serves as a gate insulating film. As the second insulating film, a single layer or a stack of a silicon oxide film, a silicon nitride film, or a silicon oxynitride film ($SiO_xN_y$) can be used.

As the second insulating film in contact with the semiconductor layer, a silicon oxide film is preferably used. This is because the trap level at the interface between the semiconductor layer and the second insulating film can be reduced.

When the second insulating film is in contact with Mo, a silicon oxide film is preferably used as a portion of the second insulating film in contact with Mo. This is because the silicon oxide film does not oxidize Mo.

A first semiconductor layer (a semiconductor layer 7056) is formed in part of a portion over the second insulating film, which overlaps with the first conductive layer, by a photolithography method, an inkjet method, a printing method, or the like. Part of the semiconductor layer 7056 extends to a portion over the second insulating film, which does not overlap with the first conductive layer. The semiconductor layer 7056 includes a portion functioning as a channel region of the transistor 7068. As the semiconductor layer 7056, a semiconductor layer having no crystallinity, such as an amorphous silicon (a-Si:H) layer, a semiconductor layer such as a microcrystalline silicon (μ-Si:H) layer, or the like can be used.

A second semiconductor layer (a semiconductor layer 7057 and a semiconductor layer 7058) is formed over part of the first semiconductor layer. The semiconductor layer 7057 includes a portion functioning as one of a source electrode and a drain electrode. The semiconductor layer 7058 includes a portion functioning as the other of the source electrode and the drain electrode. As the second semiconductor layer, silicon containing phosphorus or the like can be used, for example.

A second conductive layer (a conductive layer 7059, a conductive layer 7060, and a conductive layer 7061) is formed over the second semiconductor layer and the second insulating film. The conductive layer 7059 includes a portion functioning as one of the source electrode and the drain electrode of the transistor 7068. The conductive layer 7060 includes a portion functioning as the other of the source electrode and the drain electrode of the transistor 7068. The conductive layer 7061 includes a portion functioning as a second electrode of the capacitor 7069. As the second conductive layer, Ti, Mo, Ta, Cr, W, Al, Nd, Cu, Ag, Au, Pt, Nb, Si, Zn, Fe, Ba, or Ge, or an alloy of these elements can be used. Further, a stack including any of these elements (including an alloy thereof) can be used.

Note that in steps after the second conductive layer is formed, a variety of insulating films or conductive films may be formed.

Here, an example of a step which is characteristic of the channel-etched transistor is described. The first semiconductor layer and the second semiconductor layer can be formed using the same mask. Specifically, the first semiconductor layer and the second semiconductor layer are continuously formed. Moreover, the first and second semiconductor layers are formed using the same mask.

Another example of a step which is characteristic of the channel-etched transistor is described. A channel region of the transistor can be formed without using an additional mask. Specifically, after the second conductive layer is formed, part of the second semiconductor layer is removed using the second conductive layer as a mask. Alternatively, part of the second semiconductor layer is removed using the same mask as the second conductive layer. The first semiconductor layer below the removed second semiconductor layer serves as the channel region of the transistor.

FIG. 13C illustrates cross-sectional structures of an inverted staggered (bottom-gate) transistor and a capacitor. In particular, the transistor illustrated in FIG. 13C has a channel protection (channel stop) structure.

A first insulating film (an insulating film 7072) is formed entirely over a substrate 7071. The first insulating film can prevent impurities from the substrate from adversely affecting a semiconductor layer and changing characteristics of the transistor. That is, the first insulating film functions as a base film. Accordingly, a highly reliable transistor can be manufactured. As the first insulating film, a single layer or a stack of a silicon oxide film, a silicon nitride film, or a silicon oxynitride film ($SiO_xN_y$) can be used.

Note that the first insulating film is not necessarily formed. If the first insulating film is not formed, the number of steps can be reduced, and manufacturing costs can be reduced. Since the structure can be simplified, the yield can be increased.

A first conductive layer (a conductive layer 7073 and a conductive layer 7074) is formed over the first insulating film. The conductive layer 7073 includes a portion functioning as a gate electrode of a transistor 7088. The conductive layer 7074 includes a portion functioning as a first electrode of a capacitor 7089. As the first conductive layer, Ti, Mo, Ta, Cr, W, Al, Nd, Cu, Ag, Au, Pt, Nb, Si, Zn, Fe, Ba, or Ge, or an alloy of these elements can be used. Further, a stack including any of these elements (including an alloy thereof) can be used.

A second insulating film (an insulating film 7075) is formed so as to cover at least the first conductive layer. The second insulating film serves as a gate insulating film. As the second insulating film, a single layer or a stack of a silicon oxide film, a silicon nitride film, or a silicon oxynitride film ($SiO_xN_y$) can be used.

As the second insulating film in contact with the semiconductor layer, a silicon oxide film is preferably used. This is because the trap level at the interface between the semiconductor layer and the second insulating film can be reduced.

When the second insulating film is in contact with Mo, a silicon oxide film is preferably used as a portion of the second insulating film in contact with Mo. This is because the silicon oxide film does not oxidize Mo.

A first semiconductor layer (a semiconductor layer 7076) is formed in part of a portion over the second insulating film, which overlaps with the first conductive layer, by a photolithography method, an inkjet method, a printing method, or the like. Part of the semiconductor layer 7078 extends to a portion over the second insulating film, which does not overlap with the first conductive layer. The semiconductor layer 7076 includes a portion functioning as a channel region of the transistor 7088. As the semiconductor layer 7076, a semiconductor layer having no crystallinity, such as an amorphous silicon (a-Si:H) layer, a semiconductor layer such as a microcrystalline silicon (μ-Si:H) layer, or the like can be used.

A third insulating film (an insulating film 7082) is formed over part of the first semiconductor layer. The insulating film 7082 has a function of preventing the channel region of the transistor 7088 from being removed by etching. That is, the insulating film 7082 serves as a channel protection film (a channel stop film). As the third insulating film, a single layer or a stack of a silicon oxide film, a silicon nitride film, or a silicon oxynitride film ($SiO_xN_y$) can be used.

A second semiconductor layer (a semiconductor layer 7077 and a semiconductor layer 7078) is formed over part of the first semiconductor layer and part of the third insulating film. The semiconductor layer 7077 includes a portion functioning as one of a source electrode and a drain electrode. The semiconductor layer 7078 includes a portion functioning as the other of the source electrode and the drain electrode. As the second semiconductor layer, silicon containing phosphorus or the like can be used, for example.

A second conductive layer (a conductive layer 7079, a conductive layer 7080, and a conductive layer 7081) is formed over the second semiconductor layer. The conductive layer 7079 includes a portion functioning as one of the source electrode and the drain electrode of the transistor 7088. The conductive layer 7080 includes a portion functioning as the other of the source electrode and the drain electrode of the transistor 7088. The conductive layer 7081 includes a portion functioning as a second electrode of the capacitor 7089. As the second conductive layer, Ti, Mo, Ta, Cr, W, Al, Nd, Cu, Ag, Au, Pt, Nb, Si, Zn, Fe, Ba, or Ge, or an alloy of these elements can be used. Further, a stack including any of these elements (including an alloy thereof) can be used.

Note that in steps after the second conductive layer is formed, a variety of insulating films or conductive films may be formed.

Next, an example in which a semiconductor substrate is used as a substrate for forming a transistor will be described. Since a transistor formed using the semiconductor substrate has high mobility, the size of the transistor can be reduced. Accordingly, the number of transistors per unit area can be increased (the degree of integration can be improved), and the size of the substrate can be reduced as the degree of integration is increased in the case of employing the same circuit configuration; thus, manufacturing costs can be reduced. Further, the circuit scale can be increased as the degree of integration is increased in the case of the same substrate size; thus, more advanced functions can be provided without increase in manufacturing cost. Moreover, small variations in characteristics can increase production yield. Further, low operating voltage can reduce power consumption. Furthermore, high mobility can realize higher-speed operation.

When a circuit including transistors formed using a semiconductor substrate is mounted on a device in the form of an IC chip or the like, the device can be provided with a variety of functions. For example, when a peripheral driver circuit (e.g., a data driver (a source driver), a scan driver (a gate driver), a timing controller, an image processing circuit, an interface circuit, a power supply circuit, or an oscillation circuit) in a display device includes transistors formed using a semiconductor substrate, a small peripheral circuit which can be operated with low power consumption at high speed can be formed at low cost in high yield. Note that the circuit including transistors formed using a semiconductor substrate may include a unipolar transistor. Thus, a manufacturing process can be simplified, so that manufacturing costs can be reduced.

The circuit including transistors formed using a semiconductor substrate may also be used for a display panel, for example. More specifically, the circuit can be used for a reflective liquid crystal panel such as a liquid crystal on silicon (LCOS) device, a digital micromirror device (DMD) in which micromirrors are integrated, an EL panel, and the like. By forming such a display panel with the use of a semiconductor substrate, a small display panel which can be operated with low power consumption at high speed can be formed at low cost in high yield. Note that the display panel may be formed over an element having a function other than a function of driving a display panel, such as a large-scale integrated circuit (LSI).

A method for forming a transistor with the use of a semiconductor substrate is described below. As an example, transistors are formed through steps illustrated in FIGS. 14A to 14G.

Figure 14A:
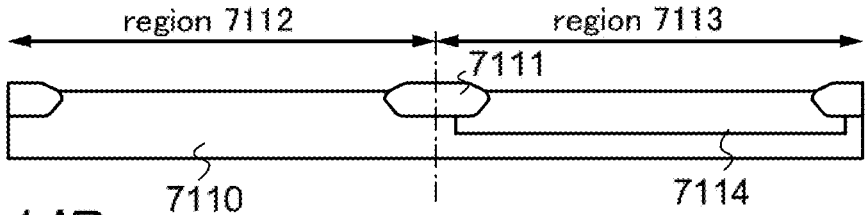
FIGS. 14A to 14G illustrate an example of manufacturing a semiconductor element.

FIG. 14A illustrates regions 7112 and 7113 by which an element is isolated in a semiconductor substrate 7110, an insulating film 7111 (also referred to as a field oxide film), and a p-well 7114.

Any semiconductor substrate can be used as the substrate 7110, without limitation on a certain type. For example, a single crystal Si substrate having n-type or p-type conductivity, a compound semiconductor substrate (e.g., a GaAs substrate, an InP substrate, a GaN substrate, a SiC substrate, a sapphire substrate, or a ZnSe substrate), an SOI (silicon on insulator) substrate formed by a bonding method or a SIMOX (separation by implanted oxygen) method, or the like can be used.

Figure 14B:
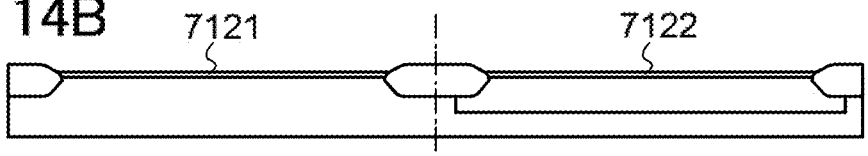

FIG. 14B illustrates an insulating film 7121 and an insulating film 7122. For example, the insulating films 7121 and 7122 can be formed of silicon oxide films formed by oxidizing surfaces of the regions 7112 and 7113 provided in the semiconductor substrate 7110 by heat treatment.

Figure 14C:
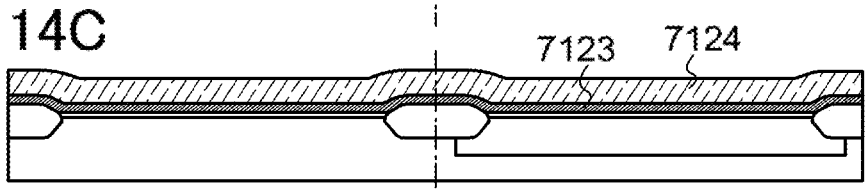
Figure 14D:
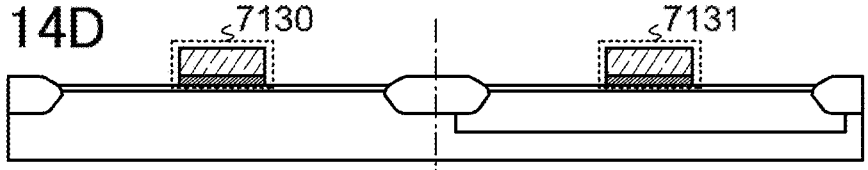
Figure 14E:
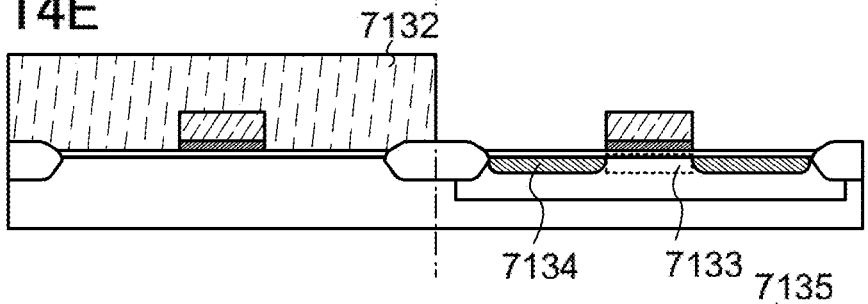
Figure 14F:
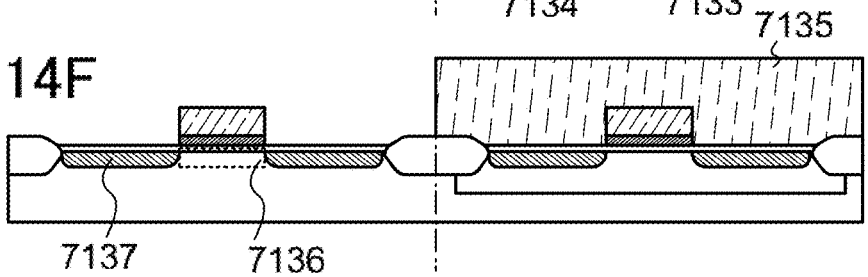
Figure 14G:
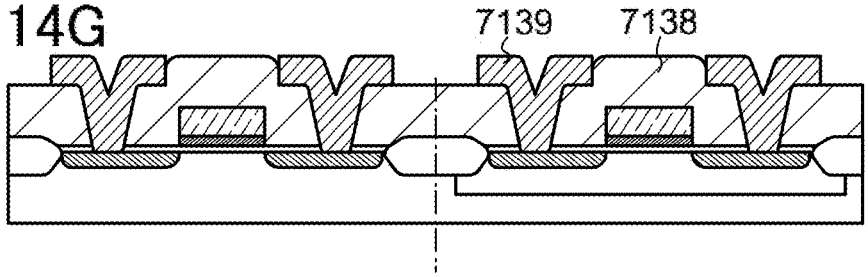

FIG. 14C illustrates a conductive film 7123 and a conductive film 7124.

As a material of the conductive films 7123 and 7124, an element selected from tantalum (Ta), tungsten (W), titanium (Ti), molybdenum (Mo), aluminum (Al), copper (Cu), chromium (Cr), niobium (Nb), and the like, or an alloy material or a compound material containing such an element as its main component can be used. Moreover, a metal nitride film obtained by nitridation of the above element can be used. Alternatively, a semiconductor material typified by polycrystalline silicon doped with an impurity element such as phosphorus, or silicide in which a metal material is introduced can be used.

FIGS. 14D to 14G illustrate a gate electrode 7130, a gate electrode 7131, a resist mask 7132, an impurity region 7134, a channel formation region 7133, a resist mask 7135, an impurity region 7137, a channel formation region 7136, a second insulating film 7138, and wirings 7139.

The second insulating film 7138 can be formed to have a single-layer structure or a layered structure of an insulating film containing oxygen and/or nitrogen such as silicon oxide ($SiO_x$), silicon nitride ($SiN_x$), silicon oxynitride ($SiO_xN_y$, $x>y$), or silicon nitride oxide ($SiN_xO_y$, $x>y$); a film containing carbon such as DLC (diamond-like carbon); an organic material such as epoxy, polyimide, polyamide, polyvinyl phenol, benzocyclobutene, or acrylic; or a siloxane material such as a siloxane resin by a CVD method, a sputtering method, or the like. Note that a siloxane material corresponds to a material having Si—O—Si bonds. Siloxane has a skeleton structure of a bond of silicon (Si) and oxygen (O). As a substituent, an organic group (e.g., an alkyl group or aromatic hydrocarbon) or a fluoro group may be used. A fluoro group may be included in the organic group.

The wirings 7139 are formed with a single layer or a stack of an element selected from aluminum (Al), tungsten (W), titanium (Ti), tantalum (Ta), molybdenum (Mo), nickel (Ni), platinum (Pt), copper (Cu), gold (Au), silver (Ag), manganese (Mn), neodymium (Nd), carbon (C), and silicon (Si), or an alloy material or a compound material containing such an element as its main component by a CVD method, a sputtering method, or the like. An alloy material containing aluminum as its main component corresponds to, for example, a material which contains aluminum as its main component and also contains nickel, or a material which contains aluminum as its main component and also contains nickel and one or both of carbon and silicon. The wirings 7139 are preferably formed to have, for example, a layered structure of a barrier film, an aluminum-silicon (Al—Si) film, and a barrier film or a layered structure of a barrier film, an aluminum-silicon (Al—Si) film, a titanium nitride film, and a barrier film. Note that the barrier film refers to a thin film containing titanium, nitride of titanium, molybdenum, or nitride of molybdenum. Aluminum and aluminum silicon are suitable materials for forming the wirings 7139 because they have low resistance values and are inexpensive. For example, when barrier layers are provided as the top layer and the bottom layer, generation of hillocks of aluminum or aluminum silicon can be prevented. For example, when a barrier film is formed of titanium, which is an element having a high reducing property, even if a thin native oxide film is formed on a crystalline semiconductor film, the native oxide film is reduced. Accordingly, the wirings 7139 can be electrically and physically connected to the crystalline semiconductor film in favorable conditions.

Note that the structure of a transistor is not limited to the structure illustrated in the drawing. For example, the transistor can have a structure such as an inverted staggered structure or a finFET structure. A FinFET structure is preferable because it can suppress short channel effect due to reduction in transistor size.

The structures and the manufacturing method of transistors have been described above. Here, a wiring, an electrode, a conductive layer, a conductive film, a terminal, a via, a plug, and the like are preferably formed using one or more elements selected from aluminum (Al), tantalum (Ta), titanium (Ti), molybdenum (Mo), tungsten (W), neodymium (Nd), chromium (Cr), nickel (Ni), platinum (Pt), gold (Au), silver (Ag), copper (Cu), magnesium (Mg), scandium (Sc), cobalt (Co), zinc (Zn), niobium (Nb), silicon (Si), phosphorus (P), boron (B), arsenic (As), gallium (Ga), indium (In), tin (Sn), and oxygen (O); or a compound or an alloy material containing one or more of the above elements (e.g., indium tin oxide (ITO), indium zinc oxide (IZO), indium tin oxide containing silicon oxide (ITSO), zinc oxide (ZnO), tin oxide (SnO), cadmium tin oxide (CTO), aluminum neodymium (Al—Nd), magnesium silver (Mg—Ag), or molybdenum neodymium (Mo—Nb)). Alternatively, the wiring, the electrode, the conductive layer, the conductive film, the terminal, and the like are preferably formed using, for example, a substance in which these compounds are combined. Alternatively, they are preferably formed using a compound (silicide) of silicon and one or more of the above elements (e.g., aluminum silicon, molybdenum silicon, or nickel silicide), or a compound of nitrogen and one or more of the above elements (e.g., titanium nitride, tantalum nitride, or molybdenum nitride).

Note that silicon (Si) may contain an n-type impurity (e.g., phosphorus) or a p-type impurity (e.g., boron). The impurity contained in silicon can increase the conductivity or enables the same performance as normal conductors. Thus, such silicon can be used easily as a wiring, an electrode, or the like.

Note that silicon with various levels of crystallinity, such as single crystal silicon, polycrystalline silicon (polysilicon), or microcrystalline (microcrystal) silicon, can be used. Alternatively, silicon having no crystallinity, such as amorphous silicon, can be used. By using single crystal silicon or polycrystalline silicon, the resistance of a wiring, an electrode, a conductive layer, a conductive film, a terminal, or the like can be reduced. By using amorphous silicon or microcrystalline silicon, a wiring or the like can be formed by a simple process.

In addition, aluminum and silver have high conductivity, so that signal delay can be reduced. Since aluminum and silver can be easily etched, they can be easily patterned and minutely processed.

Since copper has high conductivity, signal delay can be reduced. In using copper, a layered structure is preferably used to increase the adhesion.

Molybdenum and titanium are preferable because even if molybdenum or titanium is in contact with an oxide semiconductor (e.g., ITO or IZO) or silicon, molybdenum or titanium does not cause defects. Moreover, molybdenum and titanium are easily etched and have high-heat resistance.

Tungsten is preferable since it has advantages such as high heat resistance.

Neodymium is preferable because it has advantages such as high heat resistance. In particular, an alloy of neodymium and aluminum is preferable because heat resistance is increased, and hillocks are hardly generated in aluminum.

Silicon is preferable since it can be formed at the same time as a semiconductor layer included in a transistor, and has high heat resistance.

Since ITO, IZO, ITSO, zinc oxide (ZnO), silicon (Si), tin oxide (SnO), and cadmium tin oxide (CTO) have light-transmitting properties, they can be used as a portion through which light should pass. For example, these materials can be used for a pixel electrode or a common electrode.

IZO is preferable because it is easily etched and processed. In etching IZO, almost no residues of IZO are left. Accordingly, when a pixel electrode is formed using IZO, defects (such as short-circuit or orientation disorder) of a liquid crystal element or a light-emitting element can be reduced.

Note that a wiring, an electrode, a conductive layer, a conductive film, a terminal, a via, a plug, and the like may have a single-layer structure or a multilayer structure. By employing a single-layer structure, a manufacturing process of such a wiring, electrode, conductive layer, conductive film, terminal, or the like can be simplified; thus, the number of days for the process can be reduced, and costs can be reduced. Alternatively, by employing a multilayer structure, a wiring, an electrode, and the like with high quality can be formed while an advantage of each material is utilized and a disadvantage thereof is reduced. For example, when a low-resistant material (e.g., aluminum) is included in a multilayer structure, the resistance of a wiring can be reduced. As another example, by employing a layered structure in which a low heat-resistant material is placed between high heat-resistant materials, the heat resistance of a wiring, an electrode, or the like can be increased, utilizing advantages of the low heat-resistance material. For example, it is preferable to employ a layered structure in which a layer containing aluminum is placed between layers containing molybdenum, titanium, neodymium, or the like.

If wirings or electrodes are in direct contact with each other, they adversely affect each other in some cases. For example, one wiring or one electrode is mixed into a material of another wiring or another electrode and changes its properties, so that a desired function cannot be obtained. As another example, when a high-resistant portion is formed, a problem may occur so that such a portion cannot be normally formed. In such a case, a reactive material is preferably sandwiched by or covered with a non-reactive material in a layered structure. For example, when ITO is connected to aluminum, titanium, molybdenum, or an alloy of neodymium is preferably disposed between ITO and aluminum. As another example, when silicon is connected to aluminum, titanium, molybdenum, or an alloy of neodymium is preferably disposed between silicon and aluminum.

Note that the term "wiring" indicates a portion including a conductor. The shape of such a wiring may be linear or may be short without a linear shape. Therefore, an electrode is included in a wiring.

Note that a carbon nanotube may be used for a wiring, an electrode, a conductive layer, a conductive film, a terminal, a via, a plug, and the like. Since the carbon nanotube has a light-transmitting property, it can be used for a portion through which light should pass. For example, the carbon nanotube can be used for a pixel electrode or a common electrode.

Note that this embodiment is described with reference to a variety of drawings, and what is described (or part thereof) with reference to one drawing can be freely applied to, combined with, or exchanged with what is described (or part thereof) in another drawing or a drawing in another embodiment. Further, in the above-mentioned drawings, each portion can be combined with another portion and a portion in another embodiment.

Embodiment 4

In this embodiment, examples of electronic devices each including the display device described in the above embodiment will be described.

FIGS. 15A to 15H and FIGS. 16A to 16D each illustrate an electronic device. These electronic devices can each include a housing 5000, a display portion 5001, a speaker 5003, an LED lamp 5004, an operation key 5005, a connection terminal 5006, a sensor 5007 (a sensor having a function of measuring force, displacement, position, speed, acceleration, angular velocity, rotational frequency, distance, light, liquid, magnetism, temperature, chemical substance, sound, time, hardness, electric field, current, voltage, electric power, radiation, flow rate, humidity, gradient, oscillation, odor, or infrared rays), a microphone 5008, and the like.

Figure 15A:
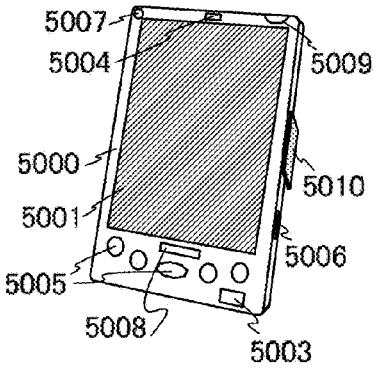
FIGS. 15A to 15H each illustrate an electronic device.
Figure 15B:
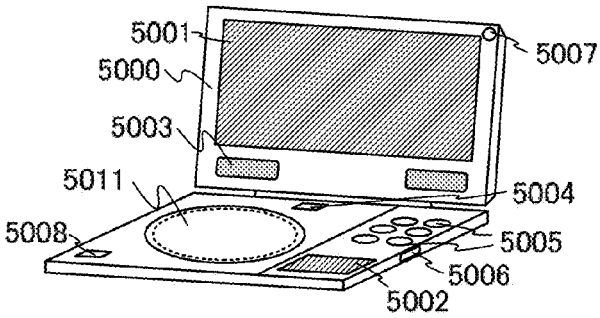
Figure 15C:
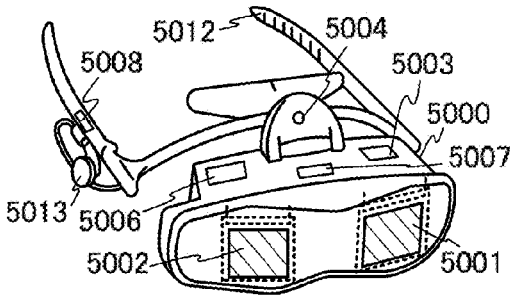
Figure 15D:
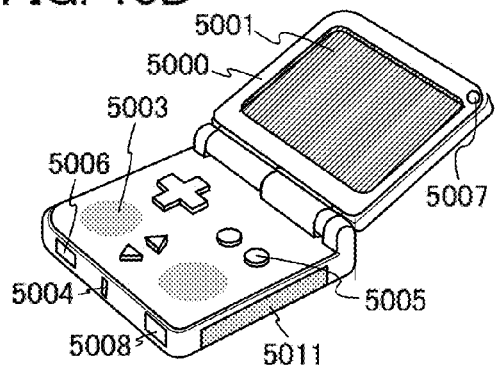
Figure 15E:
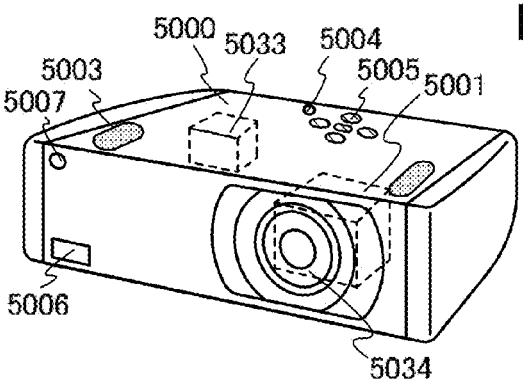
Figure 15F:
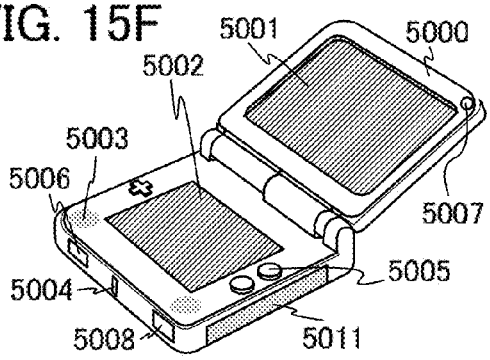
Figure 15G:
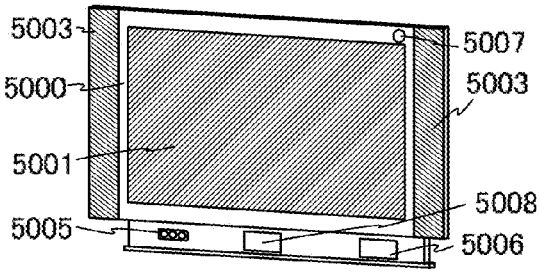
Figure 15H:
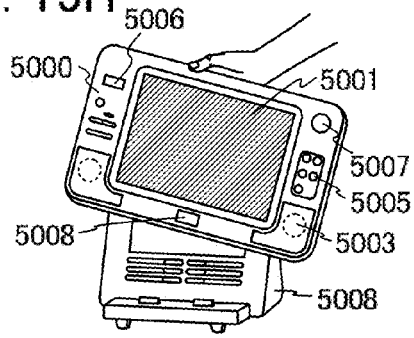
Figure 16A:
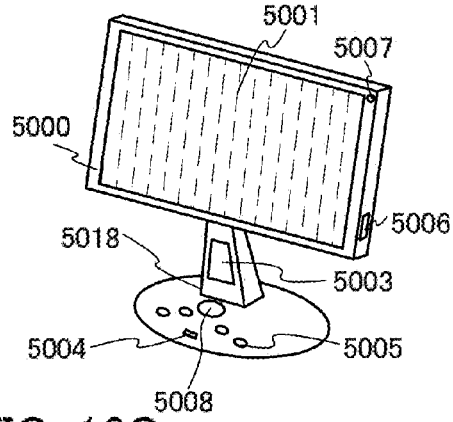
FIGS. 16A to 16H each illustrate an electronic device.
Figure 16B:
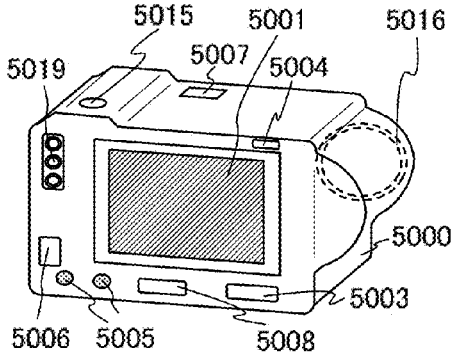
Figure 16C:
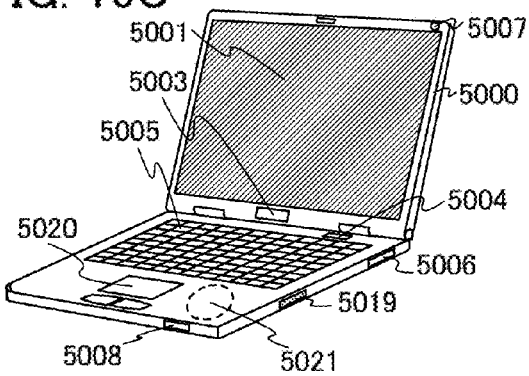
Figure 16D:
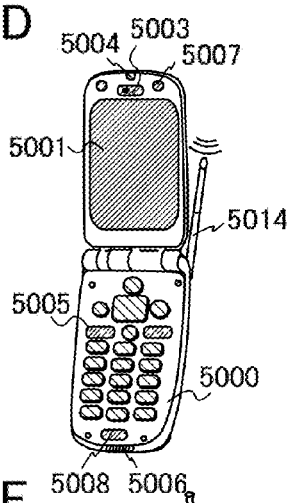

FIG. 15A illustrates a mobile computer which can include a switch 5009, an infrared port 5010, and the like in addition to the above objects. FIG. 15B illustrates a portable image reproducing device (e.g., a DVD reproducing device) provided with a recording medium, which can include a second display portion 5002, a recording medium reading portion 5011, and the like in addition to the above objects. FIG. 15C illustrates a goggle-type display which can include the second display portion 5002, a supporting portion 5012, an earphone 5013, and the like in addition to the above objects. FIG. 15D illustrates a portable game machine which can include the recording medium reading portion 5011 and the like in addition to the above objects. FIG. 15E illustrates a projector which can include a light source 5033, a projection lens 5034, and the like in addition to the above objects. FIG. 15F illustrates a portable game machine which can include the second display portion 5002, the recording medium reading portion 5011, and the like in addition to the above objects. FIG. 15G illustrates a television receiver which can include a tuner, an image processing portion, and the like in addition to the above objects. FIG. 15H illustrates a portable television receiver which can include a charger 5017 that can transmit and receive signals, and the like in addition to the above objects. FIG. 16A illustrates a display which can include a supporting board 5018 and the like in addition to the above objects. FIG. 16B illustrates a camera which can include an external connection port 5019, a shutter button 5015, an image receiver portion 5016, and the like in addition to the above objects. FIG. 16C illustrates a computer which can include a pointing device 5020, the external connection port 5019, a reader/writer 5021, and the like in addition to the above objects. FIG. 16D illustrates a mobile phone which can include an antenna 5014, a tuner of one-segment partial reception service for mobile phones and mobile terminals ("1seg"), and the like in addition to the above objects.

The electronic devices illustrated in FIGS. 15A to 15H and FIGS. 16A to 16D can have a variety of functions, for example, a function of displaying a variety of information (e.g., a still image, a moving image, and a text image) on a display portion, a touch panel function, a function of displaying a calendar, date, time, and the like, a function of controlling processing with a variety of software (programs), a wireless communication function, a function of being connected to a variety of computer networks with a wireless communication function, a function of transmitting and receiving a variety of data with a wireless communication function, and a function of reading program or data stored in a recording medium and displaying the program or data on a display portion. Further, the electronic device including a plurality of display portions can have a function of displaying image information mainly on one display portion while displaying text information on another display portion, a function of displaying a three-dimensional image by displaying images in consideration of parallax on a plurality of display portions, or the like. Furthermore, the electronic device including an image receiver portion can have a function of shooting a still image, a function of shooting a moving image, a function of automatically or manually correcting a shot image, a function of storing a shot image in a recording medium (an external recording medium or a recording medium incorporated in a camera), a function of displaying a shot image on the display portion, or the like. Note that functions which can be provided for the electronic devices illustrated in FIGS. 15A to 15H and FIGS. 16A to 16D are not limited thereto, and the electronic devices can have a variety of functions.

Next, application examples of electronic devices each including the display device will be described.

Figure 16E:
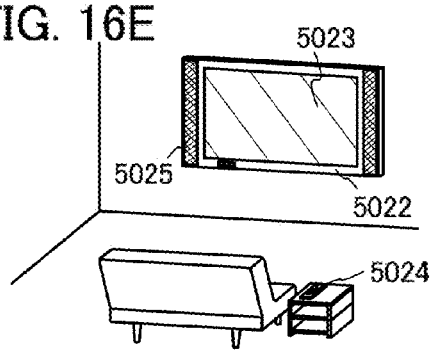

FIG. 16E illustrates an example in which a display device is provided so as to be integrated with a building. FIG. 16E illustrates a housing 5022, a display portion 5023, a remote controller device 5024 which is an operation portion, a speaker 5025, and the like. The display device is integrated with the building as a wall-hanging device and can be provided without a large space.

Figure 16F:
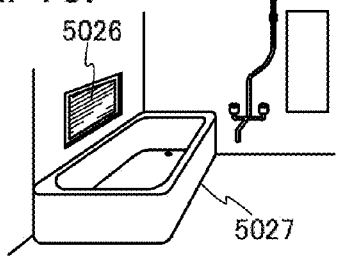

FIG. 16F illustrates another example in which a display device is provided so as to be integrated within a building. A display panel 5026 is integrated with a prefabricated bath 5027, so that a person who takes a bath can watch the display panel 5026.

Note that although this embodiment gives the wall and the prefabricated bath as examples of the building, this embodiment is not limited thereto and the display device can be provided in a variety of buildings.

Next, examples in which the display device is provided so as to be integrated with a moving body will be described.

Figure 16G:
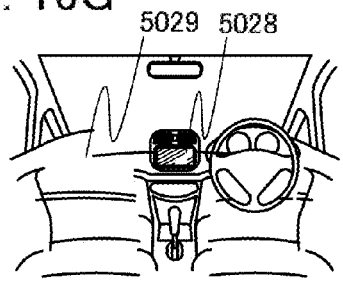

FIG. 16G illustrates an example in which the display device is provided in a vehicle. A display panel 5028 is attached to a body 5029 of the vehicle and can display information on the operation of the body or information input from the outside of the body on demand. Note that the display panel 5028 may have a navigation function.

Figure 16H:
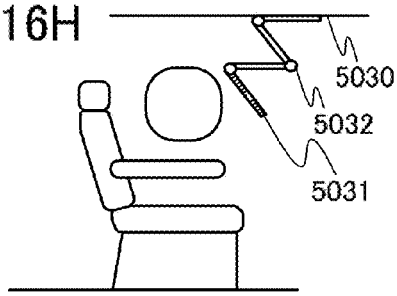

FIG. 16H illustrates an example in which the display device is provided so as to be integrated with a passenger airplane. FIG. 16H illustrates a usage pattern when a display panel 5031 is provided on a ceiling 5030 above a seat in the passenger airplane. The display panel 5031 is integrated with the ceiling 5030 through a hinge portion 5032, and a passenger can watch the display panel 5031 by extending and contracting the hinge portion 5032. The display panel 5031 has a function of displaying information when operated by the passenger.

Note that although this embodiment gives the body of the vehicle and the body of the plane as examples of the moving body, this embodiment is not limited thereto. The display device can be provided for a variety of moving bodies such as a two-wheeled motor vehicle, a four-wheeled vehicle (including a car, bus, and the like), a train (including a monorail, a railway, and the like), and a ship.

Note that this embodiment is described with reference to a variety of drawings, and what is described (or part thereof) with reference to one drawing can be freely applied to, combined with, or exchanged with what is described (or part thereof) in another drawing or a drawing in another embodiment. Further, in the above-mentioned drawings, each portion can be combined with another portion and a portion in another embodiment. Accordingly, the display device described in the above embodiment is used for a display portion of an electronic device, whereby image quality defects can be reduced.

This application is based on Japanese Patent Application serial no. 2008-309273 filed with Japan Patent Office on Dec. 4, 2008, the entire contents of which are hereby incorporated by reference.

What is claimed is:

1. A display device comprising:
a first wiring;
a second wiring; and
a pixel, the pixel comprising:
a transistor;
a compensation circuit electrically connected to a first terminal, a second terminal, and a gate terminal of the transistor, and configured to hold a threshold voltage applied between the gate terminal and the first terminal of the transistor and a video voltage;
a first switch electrically connected to the first terminal of the transistor and the first wiring, and configured to control electrical conduction between the first wiring and the first terminal of the transistor;
a second switch electrically connected to the first terminal of the transistor and the second wiring, and configured to control electrical conduction between the second wiring and the first terminal of the transistor; and
a light-emitting element having:
a first terminal electrically connected to the first wiring through the compensation circuit, the transistor, and the first switch, and the second wiring through the compensation circuit, the transistor, and the second switch; and
a second terminal electrically connected to a third wiring.

2. The display device according to claim 1, wherein a width of the first wiring is larger than a width of the second wiring.

3. The display device according to claim 1, wherein a width of the first wiring and a width of the second wiring vary by color element of the light-emitting element.

4. The display device according to claim 1, wherein the display device is applied to an electronic device.

5. The display device according to claim 4, wherein the electronic device is selected from the group consisting of a personal computer, a digital camera, a video camera, a portable information terminal, a navigation system, an electronic game machine, and a player for reproducing a recording medium.

6. The display device according to claim 5, wherein the portable information terminal is selected from the group consisting of a mobile computer, a mobile telephone, and an electronic book.

7. A display device comprising:
a first wiring;
a second wiring; and
a pixel, the pixel comprising:
a transistor;
a compensation circuit electrically connected to a first terminal, a second terminal, and a gate terminal of the transistor, and configured to hold a threshold voltage applied between the gate terminal and the first terminal of the transistor and a video voltage;
a first switch electrically connected to the first terminal of the transistor and the first wiring, and configured to control electrical conduction between the first wiring and the first terminal of the transistor;
a second switch electrically connected to the first terminal of the transistor and the second wiring, and configured to control electrical conduction between the second wiring and the first terminal of the transistor; and
a light-emitting element having:
a first terminal electrically connected to the first wiring through the compensation circuit, the transistor, and the first switch, and the second wiring through the compensation circuit, the transistor, and the second switch; and
a second terminal electrically connected to a third wiring,
wherein the third wiring is further electrically connected to the compensation circuit.

8. The display device according to claim 7, wherein a width of the first wiring is larger than a width of the second wiring.

9. The display device according to claim 7, wherein a width of the first wiring and a width of the second wiring vary by color element of the light-emitting element.

10. The display device according to claim 7, wherein the display device is applied to an electronic device.

11. The display device according to claim 10, wherein the electronic device is selected from the group consisting of a personal computer, a digital camera, a video camera, a portable information terminal, a navigation system, an electronic game machine, and a player for reproducing a recording medium.

12. The display device according to claim 11, wherein the portable information terminal is selected from the group consisting of a mobile computer, a mobile telephone, and an electronic book.

13. A display device comprising:
a first wiring;
a second wiring;
a pixel, the pixel comprising:
a transistor;
a compensation circuit electrically connected to a first terminal, a second terminal, and a gate terminal of the transistor, and configured to hold a threshold voltage applied between the gate terminal and the first terminal of the transistor and a video voltage;

a first switch electrically connected to the first terminal of the transistor and the first wiring, and configured to control electrical conduction between the first wiring and the first terminal of the transistor;

a second switch electrically connected to the first terminal of the transistor and the second wiring, and configured to control electrical conduction between the second wiring and the first terminal of the transistor; and a light-emitting element having:

a first terminal electrically connected to the first wiring through the compensation circuit, the transistor, and the first switch, and to the second wiring through the compensation circuit, the transistor, and the second switch; and a second terminal electrically connected to a third wiring; and a fourth wiring electrically connected to the compensation circuit.

14. The display device according to claim 13, wherein a width of the first wiring is larger than a width of the second wiring.

15. The display device according to claim 13, wherein a width of the first wiring and a width of the second wiring vary by color element of the light-emitting element.

16. The display device according to claim 13, wherein the display device is applied to an electronic device.

17. The display device according to claim 16, wherein the electronic device is selected from the group consisting of a personal computer, a digital camera, a video camera, a portable information terminal, a navigation system, an electronic game machine, and a player for reproducing a recording medium.

18. The display device according to claim 17, wherein the portable information terminal is selected from the group consisting of a mobile computer, a mobile telephone, and an electronic book.

19. A method for driving a display device, the display device comprising:

a first wiring;

a second wiring; and a pixel, the pixel comprising:

a transistor;

a compensation circuit electrically connected to a first terminal, a second terminal, and a gate terminal of the transistor, and configured to hold in a capacitor a threshold voltage applied between the gate terminal and the first terminal of the transistor and a video voltage applied from a signal line through a selection switch;

a first switch electrically connected to the first terminal of the transistor and the first wiring, and configured to control electrical conduction between the first wiring and the first terminal of the transistor;

a second switch electrically connected to the first terminal of the transistor and the second wiring, and configured to control electrical conduction between the second wiring and the first terminal of the transistor; and a light-emitting element having:

a first terminal electrically connected to the first wiring through the compensation circuit, the transistor, and the first switch, and to the second wiring through the compensation circuit, the transistor, and the second switch; and a second terminal electrically connected to a third wiring, the method comprising the steps of:

in a voltage program period, turning on the first switch and turning off the second switch; and in a light-emitting period, turning off the first switch and turning on the second switch, and making the light-emitting element emit light.

20. The method for driving a display device according to claim 19, wherein a voltage applied between the gate terminal and the first terminal of the transistor is modified to compensate the mobility of the transistor.

* * * * *